US007212759B2

(12) United States Patent
Kishi et al.

(10) Patent No.: US 7,212,759 B2
(45) Date of Patent: May 1, 2007

(54) HEATING DEVICE, FIXING DEVICE AND IMAGE FORMING APPARATUS

(75) Inventors: Kazuhito Kishi, Kanagawa (JP); Yasuhisa Kato, Kanagawa (JP); Akiyasu Amita, Kanagawa (JP); Masami Okamoto, Kanagawa (JP); Yasutada Tsukioka, Chiba (JP); Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 10/808,423

(22) Filed: Mar. 25, 2004

(65) Prior Publication Data

US 2004/0245241 A1 Dec. 9, 2004

(30) Foreign Application Priority Data

Mar. 27, 2003 (JP) ..... 2003-087293
Mar. 31, 2003 (JP) ..... 2003-093519

(51) Int. Cl.
*G03G 15/20* (2006.01)

(52) U.S. Cl. ..... 399/69; 399/70; 399/67

(58) Field of Classification Search ..... 399/69, 399/70, 338

See application file for complete search history.

(56) References Cited

U.S. PATENT DOCUMENTS 4,843,214 A 6/1989 Higashi et al.
5,400,123 A 3/1995 Sato et al.
5,481,350 A 1/1996 Yasui et al.
5,729,798 A 3/1998 Yasui et al.
5,745,247 A 4/1998 Yasui et al.
5,839,032 A 11/1998 Yasui et al.
5,854,465 A 12/1998 Kishi et al.
6,112,047 A 8/2000 Kato et al.
6,134,418 A 10/2000 Kato et al.
6,144,832 A 11/2000 Nimura et al.
6,239,864 B1 5/2001 Okamoto (Continued)

FOREIGN PATENT DOCUMENTS

JP 3-5779 1/1991

(Continued)

OTHER PUBLICATIONS

U.S. Appl. No. 11/283,828, filed Nov. 22, 2005, Okamoto.

(Continued)

*Primary Examiner*—David M. Gray
*Assistant Examiner*—Laura K. Roth
(74) *Attorney, Agent, or Firm*—Oblon, Spivak, McClelland, Maier & Neustadt, P.C.

(57) ABSTRACT

A heating device, a fixing device and an image forming device are disclosed for making the life-span of a capacitor thereof longer. The heating device includes a heating part having at least one heat generation part generating heat, an electricity storage device supplying electric power at a variable output voltage to the heating part and having at least one chargeable-dischargeable capacitor, a control part controlling the output voltage of the electricity storage device, and a temperature detection part detecting a temperature of a portion heated by the heat generation part. The heat generation part generates heat by using electric power supplied from the electricity storage device. When the temperature detected by the temperature detection part is higher than or equal to a predefined temperature, the control part sets a voltage of the capacitor such that the voltage of the capacitor is lower than or equal to a maximum voltage of the capacitor.

15 Claims, 19 Drawing Sheets

U.S. PATENT DOCUMENTS

| | | | | |
|---|---|---|---|---|
| 6,263,185 | B1 | 7/2001 | Kato et al. | |
| 6,394,446 | B1 | 5/2002 | Okamoto | |
| 6,411,795 | B2 | 6/2002 | Okamoto | |
| 6,542,705 | B2 | 4/2003 | Fujita et al. | |
| 6,847,792 | B2 * | 1/2005 | Nakafuji et al. | 399/69 |
| 7,002,112 | B2 * | 2/2006 | Kishi et al. | 219/216 |
| 2002/0043523 | A1 * | 4/2002 | Fujita et al. | 219/216 |
| 2004/0108309 | A1 * | 6/2004 | Dempsey | 219/216 |
| 2004/0245241 | A1 | 12/2004 | Kishi et al. | |
| 2005/0220474 | A1 * | 10/2005 | Sato et al. | 399/69 |

FOREIGN PATENT DOCUMENTS

| | | | |
|---|---|---|---|
| JP | 10-10913 | | 1/1998 |
| JP | 10-282821 | | 10/1998 |
| JP | 2002-174988 | | 6/2002 |
| JP | 2002-184554 | | 6/2002 |
| JP | 2003297526 | A * | 10/2003 |

OTHER PUBLICATIONS

U.S. Appl. No. 11/208,753, filed Aug. 23, 2005, Kishi et al.
U.S. Appl. No. 11/208,758, filed Aug. 23, 2005, Kishi et al.
U.S. Appl. No. 07/592,522, filed Oct. 4, 1990, Unknown.
U.S. Appl. No. 08/487,641, filed Jun. 7, 1995, Unknown.
U.S. Appl. No. 09/409,587, filed Sep. 30, 1999, Kato et al.
U.S. Appl. No. 10/375,031, filed Feb. 28, 2003, Amita et al.
U.S. Appl. No. 10/448,356, filed May 30, 2003, Yura et al.
U.S. Appl. No. 10/808,423, filed Mar. 25, 2004, Kishi et al.
U.S. Appl. No. 11/049,717, filed Feb. 4, 2005, Matsusaka et al.
U.S. Appl. No. 11/004,928, filed Dec. 7, 2004, Kishi et al.
U.S. Appl. No. 11/220,582, filed Sep. 8, 2005, Matsusaka et al.
U.S. Appl. No. 11/220,621, filed Sep. 8, 2005, Kishi et al.
U.S. Appl. No. 11/220,686, filed Sep. 8, 2005, Matsusaka et al.
U.S. Appl. No. 11/221,838, filed Sep. 9, 2005, Kishi et al.
U.S. Appl. No. 11/405,448, filed Apr. 18, 2006, Kishi et al.
U.S. Appl. No. 11/522,324, filed Sep. 18, 2006, Semma et al.
U.S. Appl. No. 11/402,950, filed Apr. 13, 2006, Kishi et al.

* cited by examiner

HEATING DEVICE, FIXING DEVICE AND IMAGE FORMING APPARATUS

BACKGROUND OF THE INVENTION

1. Field of the Invention

The present invention generally relates to a heating device, a fixing device and an image forming apparatus. More particularly, the present invention relates to a heating device, a fixing device and an image forming apparatus in which a capacitor thereof can have a longer life-span.

2. Description of the Related Art

Many image forming apparatuses, such as copiers, form images on recording media, such as plain papers and OHP (OverHead Projector) transparency sheets, in accordance with an electrophotographic manner because of advantages thereof on speedy image formation, image quality and costs. In such an electrophotographic manner, a toner image is formed on a recording medium, and the formed toner image is fixed by applying heat and pressure on the recording medium. As a fixing method, a heat roller manner is widely used for safety. In a typical heat roller manner, both a heating roller for applying heat with a heat generation member such as a halogen heater and a pressure roller disposed to face the heat roller integrally form a mutual pressing part called a "nip part". During passage through the nip part, a toner is fixed on a recording medium by applying heat and pressure to the recording medium onto which a toner image is transferred.

In recent years, image forming apparatuses, such as a copier and a printer, are designed to save energy because of considerable attention on environmental problems. In order to reduce energy consumption of an image forming apparatus, it is indispensable to save electric power consumed for a fixing device to fix a toner on a recording medium. In a conventional approach, power consumption of a fixing device is saved during waiting time of the image forming apparatus. Typically, the temperature of a heat roller is kept at a degree lower than a fixing temperature during the waiting time, and when the image forming apparatus is used, the temperature of the heat roller is raised to an available temperature immediately so that a user does not wait for increasing the temperature of the fixing roller. In this approach, a certain level of electric power must be supplied to the fixing device even during idle time thereof, thereby consuming an extra amount of energy. In general, it is said that the energy consumption during the waiting time reaches 70% through 80% of a total amount of energy consumption of an image forming apparatus.

Consequently, there are increasing demands of developing an image forming apparatus that can realize reduction in an amount of energy consumption to be reduced during waiting time and save electric power required to run the image forming apparatus. It is desirable that no electric power have to be supplied to such an image forming apparatus during idle time thereof. However, if an image forming apparatus were designed to consume no energy during waiting time thereof, it would take a long time, for example, a few minutes to above ten minutes, to heat the heating roller to a temperature of about 180.degree.C. at which the image forming apparatus becomes available, because the heating roller, which is configured from a metal roller made of iron or aluminum, has a large heat capacity in general. If a user has to wait for such a long time until the heating roller is heated, the user may feel inconvenienced by the image forming apparatus. For these reasons, it is desired to design a heating method that can save as a large an amount of power consumption as possible, and on the other hand, restart an image forming apparatus from waiting time thereof as fast as possible.

In order to raise the temperature of a heating roller in short time, a simple approach to increase an amount of input energy per unit time, that is, to use a larger size of rated electric power, is considered. In fact, many of image forming apparatuses capable of high speed printing, which are called "high speed machines", correspond to power supply voltage of 200V. In ordinary offices in Japan, however, the power supply of 10V and 15 A is usually available as a commercial power source. Accordingly, if such an image forming apparatus is installed in an office in Japan, equipment involved in a power source for supplying electric power to the image forming apparatus has to be subject to special treatment so that the equipment can cover the power supply voltage of 200V. Thus, such an approach to suit power source facilities in offices to the power source voltage 200V may not be a general solution.

Even if an attempt is made to raise the temperature of a heating roller in a short time, the maximum input energy is limited as long as the commercial power source of 100V and 15 A is used. In order to improve this problem, some techniques have been presented.

Japanese Laid-Open Patent Application No. 10-010913 discloses method and device in which the temperature of a fixing device can drop more slowly by supplying a lower voltage to a heating roller during waiting time of the fixing device.

Japanese Laid-Open Patent Application No. 10-282821 discloses method and device in which a secondary cell as an auxiliary power source is charged during waiting time of a fixing device, and when the fixing device is started up, electric power is supplied from the secondary cell or the primary cell together with a main power source device to shorten start up time of the fixing device.

According to the conventional technique disclosed in Japanese Laid-Open Patent Application No. 10-010913, however, since the lower voltage is supplied to the fixing device during waiting time thereof, power consumption of the image forming apparatus can be insufficiently saved. In addition, the technique is not intended to make the maximum supply power at the start up time higher than the level of electric power supplied from the main power source device.

According to the conventional technique disclosed in Japanese Laid-Open Patent Application No. 10-282821, on the other hand, electric power is supplied from the secondary cell or the primary cell together with the main power source device at start up time, and a lead-acid battery, a NiCd battery or a nickel metal hydride battery is used as the secondary cell in general. As such a secondary cell is iteratively charged and discharged, the capacity of the secondary cell is increasingly degraded. Also, as the secondary cell is discharged with a powerful current, the life-span of the secondary cell is shortened. In addition, the capacity of the secondary cell may be reduced due to a so-called "memory effect". In general, although such secondary cells can supply a large amount of current and have a long life-span, the number of allowable charge-discharge iteration times is about 500 to 1,000. If such a secondary cell is iteratively charged and discharged 20 times a day, the secondary cell comes to the end of the life-span thereof in about one month. Accordingly, it is necessary to replace the battery so frequently, thereby resulting in the corresponding replacement task and increasing in running costs for battery replacement. In addition, a lead-acid battery is not preferred as office equipment in that liquid of sulfuric acid is used in electrolytic solution in the lead-acid battery.

In addition, when supply of a large volume of electric power is started and stopped, drastic current variations and rush current increase a load on a heating circuit in a heating roller. Furthermore, input current is conducted to other circuits in the vicinity of the heating circuit, resulting in noise. For these reasons, it is not preferable to frequently switch ON or OFF electric power supplied from a high-capacity auxiliary power source. Also, when a high-capacity current is quickly supplied to the heating circuit, there is a risk that the heating circuit may be overheated due to excessive supply.

Japanese Laid-Open Patent Application No. 2002-184554 discloses a fixing device in which the above-mentioned problems can be eliminated. The disclosed fixing device can improve power saving efficiency. Also, when a large volume of electric power is supplied, the fixing device can reduce noise caused by rush current and drastic current variations. In addition, the fixing device can not only shorten start up time but also prevent a heating roller from being overheated. The fixing device includes a rechargeable capacitor in an auxiliary power source device thereof. A charger charges the capacitor of the auxiliary power source device by using electric power supplied from a main power source device of the image fixing device. A switch device alternates between charge of the auxiliary power source device and power supply from the auxiliary power source device to an auxiliary heat generation part so as to adjust an amount of electric power supplied to the auxiliary heat generation part. In the fixing device, the capacitor has some functions. The first function is to heat an auxiliary heater by using electric power supplied from the capacitor. The second function is to shorten start up time to raise a heating roller to a predetermined temperature by using the generated heat. The third function is to prevent a fixing temperature from being lowered during passage of a paper.

Although a capacitor has a considerably longer life-span than a battery, iterative charge-discharge shortens the life-span of the capacitor. For example, it is said that an electric double layer capacitor, which has been recently developed, can be iteratively charged and discharged more than 10,000 times. However, it is desirable that a capacitor have a still longer life-span in an image forming apparatus such as a copier, especially an intermittently and repeatedly used image forming apparatus.

In the following, exemplary operation and structure of a conventional electrophotographic type image forming apparatus, such as a copier, a printer and a facsimile, are described. In such an image forming apparatus, typically, a toner image is formed on a paper such as a transferred paper. Then, the toner image is fixed on the paper by heating the toner during passage of the toner adhesive paper through a fixing device.

FIG. 1 shows an exemplary structure of a conventional fixing device.

Referring to FIG. 1, a pressure part (not illustrated) applies predefined nip pressure to a fixing roller 91 via a pressure roller 92. A drive mechanism (not illustrated) revolves the fixing roller 91 clockwise and the pressure roller 92 counterclockwise in terms of the illustration. The fixing roller 91 comprises heaters 93 and 94 as heat generation parts for generating heat by using supplied electric power. The heaters 93 and 94 heat the circumferential surface of the fixing roller 91 to a reload temperature for fixing a toner. Here, a temperature detection part 95, such as a temperature sensor, is in contact with the circumferential surface of the fixing roller 91, and detects the surface temperature of the fixing roller 91.

In image formation of an image forming apparatus having the conventional fixing device, the heated fixing roller 91 and the pressure roller 92 heat a paper P, which supports a toner T thereon in an electrophotographic manner, and fix the toner T on the paper P during passage through a nip part between the fixing roller 91 and the pressure roller 92. In order to properly fix the toner T on the paper P, a predetermined amount of heat has to be applied to the toner T. Accordingly, an amount of electric power supplied to the heaters 93 and 94 is controlled to keep the circumferential surface of the fixing roller 91 at a reload temperature.

FIG. 2 shows an exemplary circuit structure of the conventional fixing device shown in FIG. 1.

Referring to FIG. 2, the heater 93 generates heat by using electric power supplied from an external power source (commercial power source) 87. On the other hand, the heater 94 generates heat by using electric power supplied from a capacitor 88 as an embodiment of an electricity storage device. When a temperature detection part 95 detects the temperature of the fixing roller 91, the detected temperature is supplied as a detection signal to CPU (Central Processing Unit) 83 via an input circuit 82. Based upon the detection signal from the temperature detection part 95, CPU 83 controls an amount of current carried to the heater 93 via a driver 84 and a switch 86 as well as an amount of current carried to the heater 94 via the switch 85 so that the surface temperature of the fixing roller 91 can be regulated to a predefined temperature. It is noted that the capacitor 88 is connected to a charge device 89 and becomes chargeable by switching of the switch 85.

FIG. 3 shows exemplary relations among power supplying time, supply power quantities and fixing roller temperatures of a conventional fixing device.

Referring to FIG. 3, when the fixing device 90 is started up with an idle status thereof, for example, by switching ON the main power source thereof, the heating roller 91 is heated to a reload temperature rapidly by carrying electricity to the heaters 93 and 94 so as to shorten waiting time until the fixing device 90 is made available. Also, if the fixing device 90 is in a steady status after reaching to the reload temperature, the temperature of the fixing roller 91 is maintained by carrying electricity to only the heater 93, as referred to in Japanese Laid-Open Patent Application No. 2002-174988.

In a conventional power supply method, however, even if an electricity storage device is charged from an external power source and a sufficient amount of electric power is already stored therein, electric power is supplied from both of the external power source and the electricity storage device to the heater 94.

SUMMARY OF THE INVENTION

It is a general object of the present invention to provide a heating apparatus, a fixing apparatus and an image forming apparatus in which one or more of the above-mentioned problems are eliminated.

A more specific object of the present invention is to provide a heating apparatus, a fixing apparatus and an image forming apparatus in which a capacitor thereof can have a longer life-span.

In order to achieve the above-mentioned objects, there is provided according to one aspect of the present invention a heating device, including: a heating part having at least one heat generation part generating heat; an electricity storage device supplying electric power at a variable output voltage to the heating part, said electricity storage device having at least one chargeable-dischargeable capacitor; a control part controlling the output voltage of the electricity storage device; and a temperature detection part detecting a temperature of a portion heated by the heat generation part, wherein the heat generation part generates heat by using electric power supplied from the electricity storage device, and when the temperature detected by the temperature detection part is higher than or equal to a predefined temperature, the control part sets a voltage of the capacitor such that said voltage of the capacitor is lower than or equal to a maximum voltage of the capacitor.

Additionally, there is provided according to another aspect of the present invention a fixing device for fixing an image on a recording medium, including: a heating device, including: a heating part having at least one heat generation part generating heat; an electricity storage device supplying electric power at a variable output voltage to the heating part, said electricity storage device having at least one chargeable-dischargeable capacitor; a control part controlling the output voltage of the electricity storage device; and a temperature detection part detecting a temperature of a portion heated by the heat generation part, wherein the heat generation part generates heat by using electric power supplied from the electricity storage device, and when the temperature detected by the temperature detection part is higher than or equal to a predefined temperature, the control part regulates a voltage of the capacitor such that said voltage of the capacitor is lower than or equal to a maximum voltage of the capacitor; and a fixing part heated by the heat generation part, wherein the recording medium passes in contact with or near the fixing part.

Additionally, there is provided according to another aspect of the present invention an image forming apparatus, including: a fixing device for fixing an image on a recording medium, including: a heating device including: a heating part having at least one heat generation part generating heat; an electricity storage device supplying electric power at a variable output voltage to the heating part, said electricity storage device having at least one chargeable-dischargeable capacitor; a control part controlling the output voltage of the electricity storage device; and a temperature detection part detecting a temperature of a portion heated by the heat generation part, wherein the heat generation part generates heat by using electric power supplied from the electricity storage device, and when the temperature detected by the temperature detection part is higher than or equal to a predefined temperature, the control part regulates a voltage of the capacitor such that said voltage of the capacitor is lower than or equal to a maximum voltage of the capacitor; and a fixing part heated by the heat generation part, wherein the recording medium passes in contact with or near the fixing part, wherein the temperature detection part is disposed in an interior of the image forming apparatus, and when a temperature of the interior is higher than or equal to a predefined temperature, the control part regulates a voltage of the capacitor such that said voltage of the capacitor is lower than or equal to a maximum voltage of the capacitor.

Additionally, there is provided according to another aspect of the present invention an image forming apparatus, including: a fixing device for fixing an image on a recording medium, including: a heating device including: a heating part having at least one heat generation part generating heat; an electricity storage device supplying electric power at a variable output voltage to the heating part, said electricity storage device having at least one chargeable-dischargeable capacitor; a control part controlling the output voltage of the capacitor device; and a mode detection part detecting an operational mode of the image forming apparatus, wherein the heat generation part generates heat by using electric power supplied from the electricity storage device, and when the operational mode detected by the mode detection part is a save mode, the control part regulates a voltage of the capacitor such that said voltage of the capacitor is lower than or equal to a maximum voltage of the capacitor; and a fixing part heated by the heat generation part, wherein the recording medium passes in contact with or near the fixing part.

According to one aspect of the present invention, if the temperature detection part detects that a temperature of a portion heated by the heater is higher than or equal to a predefined temperature, the control part controls an output voltage of the capacitor such that the output voltage can be lower than the maximum voltage of the capacitor. As a result, it is possible to make the life-span of the capacitor longer.

Additionally, there is provided according to another aspect of the present invention a fixing device for fixing a toner on a sheet, including: at least one electricity storage device; a heat generation part generating heat by using electric power supplied from the electricity storage device; a fixing member heating the toner on the sheet to fix the toner on the sheet, said fixing member heated by the heat generation part; and a power control part controlling to supply electric power from not an external power source but the electricity storage device to the heat generation part.

Additionally, there is provided according to another aspect of the present invention an image forming apparatus, including: a fixing device for fixing a toner on a sheet, including: at least one electricity storage device; a heat generation part generating heat by using electric power supplied from the electricity storage device; a fixing member heating the toner on the sheet to fix the toner on the sheet, said fixing member heated by the heat generation part; and a power control part controlling to supply electric power from not an external power source but the electricity storage device to the heat generation part, wherein the sheet on which a toner image is formed in accordance with an electrophotographic method is carried to the fixing device.

According to one aspect of the present invention, since electric power is supplied from only the electricity storage device to the heat generation part, it is possible to efficiently use electric power supplied from the external power source and lower the maximum power consumed in the external power source. Also, if the electricity storage device is configured from a capacitor, it is possible to make the life-span of the capacitor longer.

Other objects, features and advantages of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

Figure 4:
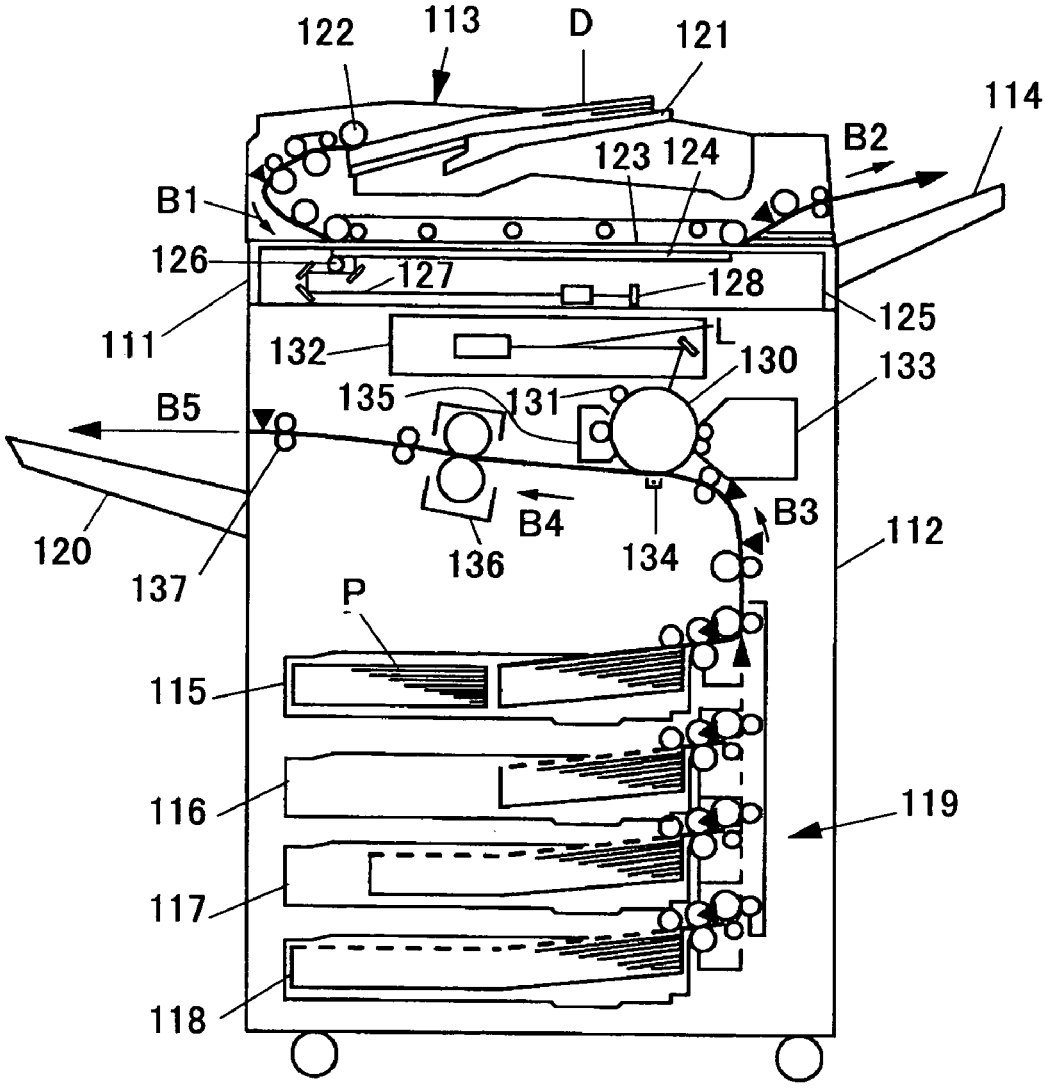
FIG. 4 is a cross-sectional view showing an exemplary structure of an image forming apparatus according to a first embodiment of the present invention.

FIG. 4 is a cross-sectional view showing an image forming apparatus, such as electrophotographic copier and printer, according to a first embodiment of the present invention.

Referring to FIG. 4, the image forming apparatus comprises a read unit 111 to read a source document, an image formation part 112 to form an image, an automatic document feeder (ADF) 113, a source document output tray 114 to stack source documents fed out from ADF 113, an input paper part 119 having input cassettes 115 through 118, and an output paper part (output paper tray) 120.

In the image forming apparatus, when a user sets one or more sheets of documents D on a document platform 121 of ADF 113 and manipulates an operation part (not illustrated), for example, pushes a print key, the documents D are delivered from the top sheet of the documents D sequentially in the B1 direction through rotation of a pickup roller 122. Then, a rotationally-driven document carrying belt 123 supplies and places each sheet of the documents D on a contact glass 124 mounted to the read unit 111. A read device 125, which is disposed between the image formation part 112 and the contact glass 124, of the read unit 111 reads each document D on the contact glass 124. The read device 125 comprises an illuminant 126 to illuminate the document D on the contact glass 124, an optical system 127 to form an image of the document D, and a photoelectric conversion element 128 having CCDs (Charge Coupled Devices) for imaging the document D. After reading of the document D, the rotationally-driven carrying belt 123 carries the document D in the B2 direction and outputs the document D on the source document output tray 114. In this fashion, each document D is fed on the contact glass 114 and is read by the read unit 111.

In the interior of the image formation part 112, a photoconductor 130, which works as an image support member, are provided. The photoconductor 130 is rotationally driven clockwise in FIG. 4. The circumferential surface of the photoconductor 130 is electrified at a predetermined potential by a charger 131. In a write unit 132 of the image forming apparatus, laser light L is optically modulated corresponding to image information read by the read device 125, and the optically-modulated laser light L is exposed on the electrified circumferential surface of the photoconductor 130 to form an electrostatic latent image. Then, a development device 133 develops the formed electrostatic latent image during passage thereof. Subsequently, a transfer device 134, which is disposed to face the photoconductor 130, transfers the developed image onto a recording medium P delivered between the photoconductor 130 and the transfer device 134. After transferring of the toner image, a cleaning device 135 cleans up the circumferential surface of the photoconductor 130.

The recording media P, such as papers, are accommodated in the plurality of input paper cassettes 115 through 118 mounted in the lower portion of the image formation part 112. From one of the input paper cassettes 115 through 118, the recording medium P is delivered in the B3 direction, and the toner image formed on the circumferential surface of the photoconductor 130 is transferred onto a surface of the recording medium P, as mentioned above. Then, the recording medium P passes through a fixing device 136 in the image formation part 112, as illustrated by the arrow B4. During the passage, the fixing device 136 fixes the toner image on the recording medium P by applying heat and pressure to the recording medium P. The fixed recording medium P is carried by an output roller pair 137 to output and stack the produced recording medium P on the output paper tray 120, as illustrated by the arrow B5.

Figure 5:
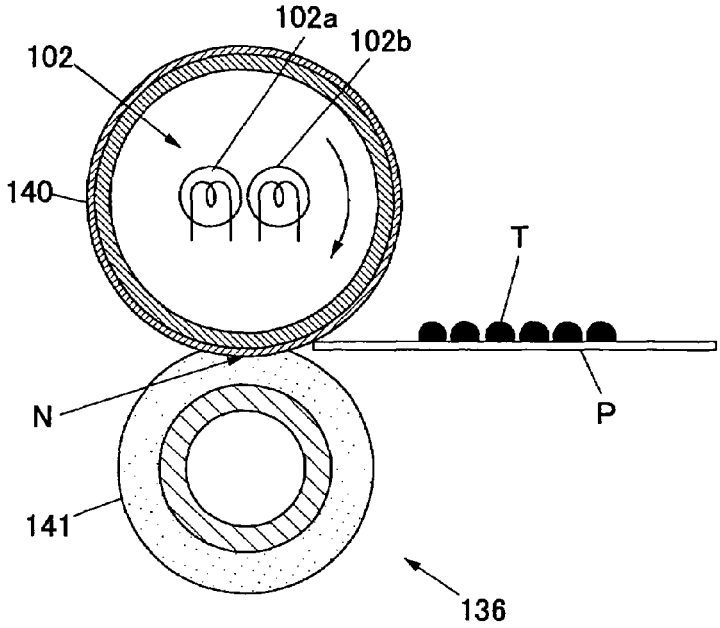
FIG. 5 is a cross-sectional view showing an exemplary structure of a fixing device according to the first embodiment.

FIG. 5 is a cross-sectional view showing the fixing device 136, which fixes a toner image on the recording medium P by applying heat and pressure, according to the first embodiment.

Referring to FIG. 5, the fixing device 136 comprises a fixing roller 140 and a pressure roller 141. The fixing roller 140 includes a heating part 102. The heating part 102 comprises a main heat generation part 102*a* and an auxiliary heat generation part 102*b*, for example, each of which is configured from a halogen heater. A nip part N is formed in a gap between the fixing roller 140 and the pressure roller 141. In the nip part N, heat and pressure are applied to the recording medium P, on which toners T are adhered, during passage through the nip part N.

Figure 6:
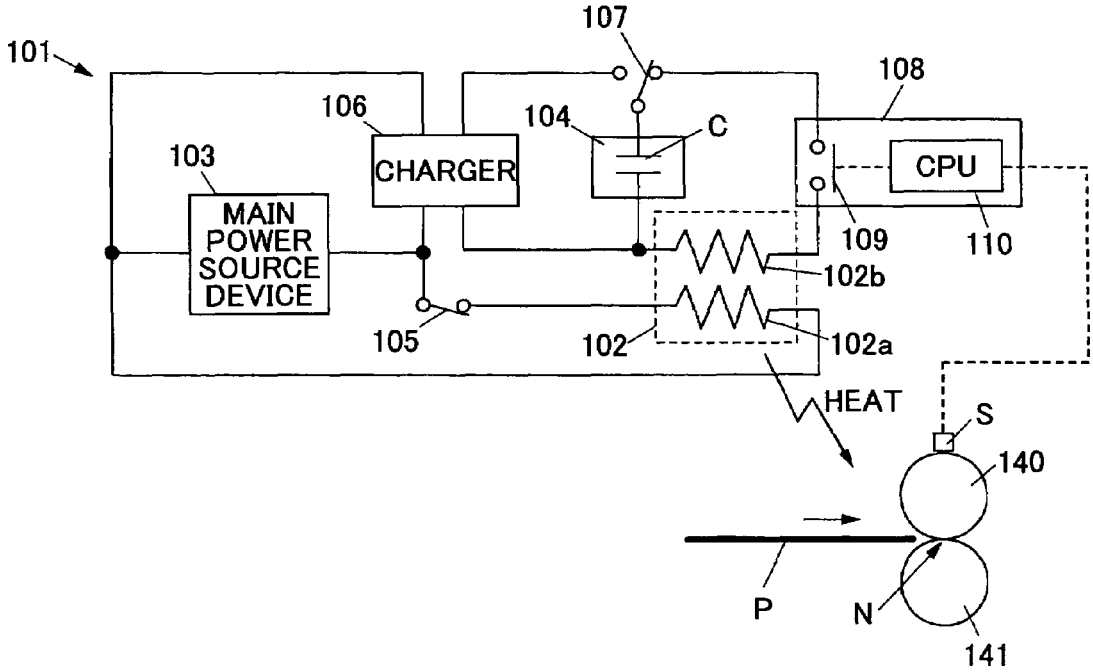
FIG. 6 is a circuit diagram of an exemplary heating device according to the first embodiment.

FIG. 6 is a circuit diagram showing an exemplary structure of a heating device incorporated in the fixing device 136 according to the first embodiment.

Referring to FIG. 6, a heating device 101 comprises a heating part 102, a main power source device 103, an auxiliary power source device 104, a main switch 105, a charger 106, a switch device 107 and a control part 108. In FIG. 6, the heating part 102, which comprises the main heat generation part 102*a* and the auxiliary heat generation part 102*b*, is illustrated in the exterior of the fixing roller 140 for convenience. In fact, however, the heat generation parts 102*a* and 102*b* are housed in the fixing roller 140.

In the heating part 102 for heating the fixing roller 140, the main heat generation part 102*a* generates heat by using electric power supplied from the main power source device 103, and the auxiliary heat generation part 102*b* generates heat by using electric power supplied from the auxiliary power source device 104. In the image forming apparatus having the heating device 101, although not illustrated in detail, electric power is supplied from an ordinary commercial power source to the main power source device 103. As well-known to those skilled in the art, the main power source device 103 has a function of adjusting electric power supplied from an outlet at a voltage level suitable for the heating part 102 and converting the supplied alternate current into a direct current, and the description and illustration thereof are omitted herein.

As shown in FIG. 6, the auxiliary power source device 104 comprises a chargeable-dischargeable capacitor C. The capacitor C may have an electrostatic capacity of about 80 F. Preferably, the capacitor C has a capacity enough to supply electric power during a few seconds through several tens of seconds, such as a so-called electric double layer capacitor having an electrostatic capacity of about 2000 F. The reason is why such an electric double layer capacitor and other similar capacitors have preferred characteristics as a secondary cell in that the capacitors do not cause chemical reaction.

The auxiliary power source device 104 having a capacitor as the secondary cell has some advantages over those having a NiCd battery. As mentioned previously, in a case where the secondary cell of the auxiliary power source device 104 is configured from an ordinary NiCd battery, it takes several hours to charge the auxiliary power source device 104 even if the auxiliary power source device 104 is charged at a high-speed. However, in a case where the auxiliary power source device 104 is configured to have a capacitor as the secondary cell thereof, it is possible to charge the auxiliary power source device 104 at a few minutes. In the latter case, even if waiting status and heating status are alternately repeated in the image forming apparatus, the auxiliary power source device 104 can reliably supply electric power to the heating part 102 at heat start time and thereby raise the temperature of the heating part 102 to a predetermined degree in short time. In addition, while a NiCd battery has problems on frequent replacement and running costs because of its life-span of 500 through 1,000 charge-discharge cycles, the auxiliary power source device 104 having an electric double layer capacitor can not only achieve an improved battery life of above 10,000 charge-discharge cycles but also reduce degradation thereof due to iterative recharge. Furthermore, while a lead-acid battery needs liquid replacement and liquid refilling, an electric double layer capacitor does not have to be subject to these treatments. As a result, if the auxiliary power source device 104 uses a capacitor as the secondary cell thereof, it is possible to reliably use the auxiliary power source device 104 in a longer span with less maintenance.

It is noted that an electric double layer capacitor has no dielectric substance and uses absorption and desorption (charge and discharge) reactions in an ion absorption layer thereof being an electric double layer in which ions or charges of solvent molecules generated on boundaries between individual electrodes and solution are concentrated. Accordingly, such an electric double layer capacitor is tolerant to iterative charge and discharge, and has a longer life-span without special maintenance. For theses reasons, an electric double layer capacitor has some advantages with respect to environments as well as high charge and discharge efficiency. Furthermore, an electric double layer capacitor having a high electrostatic capacity of several ten-thousands F and a high energy density over 10 Wh/l has been recently developed, thereby increasing the capacity of an electric double layer capacitor.

The main switch 105 switches ON/OFF electric power supplied from the main power source device 103 to the main heat generation part 102*a*. The charger 106 charges the capacitor C of the auxiliary power source device 104 by using electric power supplied from the main power source device 103. The switch device 107 is used to charge the auxiliary power source device 104 and supply electric power from the auxiliary power source device 104 to the auxiliary heat generation part 102*b* alternately.

The control part 108, which comprises a switch 109 and CPU (Central Processing Unit) 110, controls power supply from the auxiliary power source device 104 to the auxiliary heat generation part 102*b* under a predefine condition described in detail below. It is noted that the illustrated structure of the control part 108 is simply illustrative of the control part for controlling the heating part 102. The present invention is not limited to the structure, and modifications and variations can be made to the control part 108. For example, the control part 108 may be configured as a portion of an apparatus control part to control the overall operation of the image forming apparatus. Also, the present invention is not limited to the illustrated connection in terms of control over the auxiliary power source device 104. For example, the auxiliary power source device 104 may be controlled by switching the switch device 107.

An exemplary fundamental operation of the heating device 101 having the above structure is described. During waiting time, the switch device 107 connects the charger 106 to the auxiliary power source device 104 to charge the capacitor C of the auxiliary power source device 104. In this status, in order to heat the heating part 102, electric power is supplied from the main power source device 103 to the main heat generation part 102*a* by switching ON the main switch 105. At the same time, electric power is supplied from the main power source device 103 to the auxiliary heat generation part 102*b* by switching the switch device 107 to supply a large volume of electric power to the heating device 102. In this fashion, if the heating part 102 can receive a large volume of electric power from both of the main power source device 103 and the auxiliary power source device 104 at heat start time, it is possible to heat the heating part 102 to a predefined degree in short time.

After a predefined time has passed since the electric power was supplied from the auxiliary power source device 104 to the auxiliary heat generation part 102*b* of the heating part 102 for the purpose of heat generation, the control part 108 stops the electric power supplied from the auxiliary power source device 104 to the auxiliary heat generation part 102*b* to maintain the temperature of the heating part 102 at the predefined degree and prevent the heating part 102 from being overheated. As the time passes after the start of power supply, a volume of the electric power supplied from the auxiliary power source device 104 to the auxiliary heat generation part 102*b* is lowered. If the power stop time is determined depending on the reduction of the supplied electric power and the supplied electric power is stopped after the supplied electric power is reduced to a certain level, it is possible to prevent degradation and electromagnetic noise of parts of peripheral circuits during stopping of the electric power under the condition where the large volume of electric power is supplied.

When a recording medium P, onto which a toner image T is transferred, is delivered to the fixing device 136 having the above structure, the recording medium P is carried between the fixing roller 140 and the pressure roller 141. The toner image T is heated and melted with the fixing roller 140 heated to a predetermined temperature and is fixed on the recording medium P. In order to heat the fixing roller 140, the main power source device 103 and the auxiliary power source device 104 supply electric power to the main heat generation part 102*a* and the auxiliary heat generation part 102*b* of the heating part 102 of the fixing roller 140. In addition, in order to maintain the fixing temperature at a predefined or desired degree and prevent the fixing roller 140 from being overheated, electric power supplied from the auxiliary power source device 104 is controlled under appropriate switching control. The variation of the fixing temperature is controlled so that the toner T is stably heated and melted to properly fix the toner image T on the recording medium P. In addition, since the main power source device 103 and the auxiliary power source device 104 supply electric power to the main heat generation part 102*a* and the auxiliary heat generation part 102*b* of the heating part 102 of the fixing roller 140 to increase the temperature of the fixing roller 140, it is possible to increase the surface temperature of the fixing roller 140 to a predetermined fixing temperature quickly.

Figure 7A:
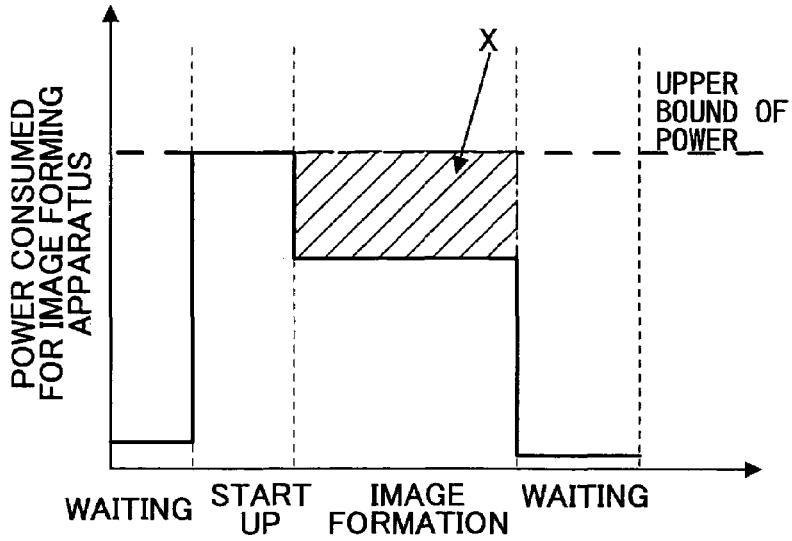
FIG. 7A is a diagram illustrating an exemplary variation of electric power consumed in the image forming apparatus shown in FIG. 4.
Figure 7B:
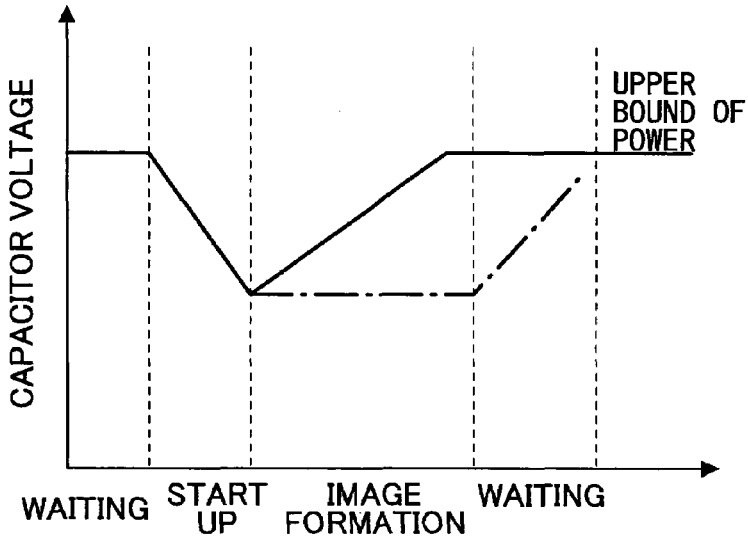
FIG. 7B is a diagram illustrating an exemplary variation of the voltage of a capacitor C according to the first embodiment.

FIG. 7A is a diagram illustrating an exemplary variation of power consumption of an image forming apparatus having the above structure. FIG. 7B is a diagram illustrating an exemplary variation of a voltage of the capacitor C.

Referring to FIG. 7A, the image forming apparatus consumes a less amount of electric power during the waiting time. At start time of forming an image, the consumed electric power is increased to an upper bound. During the image formation, the electric power is consumed at a level lower than the upper bound. After the image formation, the image forming apparatus returns to the waiting status. In general, the capacitor C of the auxiliary power source device 104 is charged by using marginal electric power during the image formation, which is illustrated as an area X in FIG. 7A.

Referring to FIG. 7B, on the other hand, the output voltage of the capacitor C reaches the maximum thereof during the waiting time. During the start time of the image formation, the output voltage of the capacitor C is decreased, because the electric power is supplied to heat the fixing roller 140. Then, the capacitor C is charged during the image formation, and returns to the waiting status.

In FIG. 7B, the solid line corresponds to a case where the capacitor C is charged during the image formation. On the other hand, the dot line corresponds to a case where the capacitor C is charged immediately after the image formation. The capacitor C is charged immediately after the image formation in general. This reason is why if the capacitor C is not charged fully before image formation immediately after the previous image formation, there is a risk that the performance of the image forming apparatus may be reduced due to reduction in copies per a minute (CPM) and waiting time for charge. Specifically, when the auxiliary power source device 104 stops supplying electric power to the auxiliary heat generation part 102*b*, the auxiliary power source device 104 is insufficiently charged. For this reason, while the heating part 102 has a stable temperature and electric power is relatively less consumed, the charger 106 is connected to the auxiliary power source device 104 by switching the switch device 107 into the charger 106 and the auxiliary power source device 104 is charged by using electric power supplied from the main power source device 103. Then, when a large volume of electric power has to be supplied to the heating part 102 again, the auxiliary power source device 104 together with the main power source device 103 supplies the large volume of electric power to the heating part 102.

Also, if the image forming apparatus is not used in long time, the voltage of the capacitor C decreases due to spontaneous discharge thereof, and it may take longer time to start up the image forming apparatus. In order to eliminate such a problem, there is an approach that the voltage of the capacitor C is automatically detected and charged as needed. In this approach, the voltage of the capacitor C is kept at the maximum voltage thereof, such as 2.5 V/cell. However, if the capacitor C is iteratively charged and discharged as mentioned above, the life-span of the capacitor C is shortened even if the capacitor C has considerably long battery life.

Based upon experience that the life-span of the capacitor C is doubled by lowering the voltage of the capacitor C by 0.1 V/cell, the capacitor C according to the first embodiment is controlled to have a lower voltage in a case where it can be predicted that no image formation will be conducted for a moment. For the purpose of implementation of the control, a temperature sensor S is provided near the fixing roller 140, as illustrated in FIG. 6. The control part 108, if the detected temperature is greater than or equal to a predefined temperature, regulates electric power supplied from the auxiliary power source device 104 to the auxiliary heat generation part 102*b* so as to decrease the voltage of the capacitor C.

Figure 8:
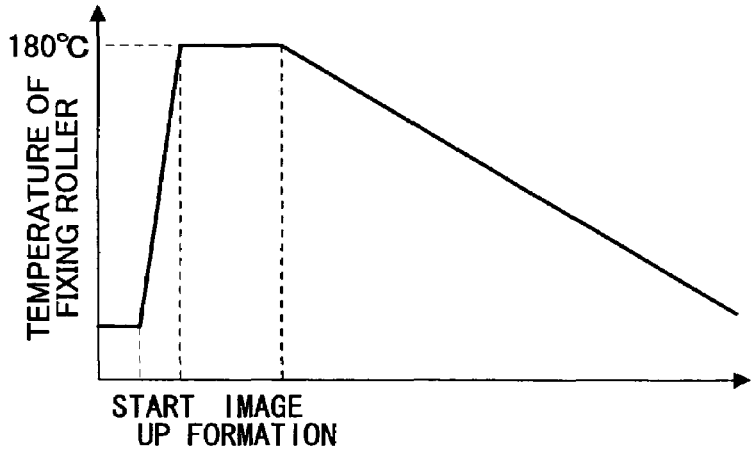
FIG. 8 is a diagram illustrating an exemplary temperature variation of a fixing roller according to the first embodiment.

FIG. 8 is a diagram illustrating an exemplary temperature variation of the fixing roller 140.

Referring to FIG. 8, the fixing roller 140 is kept at a low temperature during the waiting time. During start up time of the image forming apparatus, the heat generation parts 102*a* and 102*b* raise the temperature of the fixing roller 140 to a predefined fixing temperature (180° C. in the illustration). Then, during the image formation, the temperature of the fixing roller 140 is kept around the fixing temperature, and after completion of the image formation, the temperature is gradually lowered. In course of the temperature reduction, the temperature of the fixing roller 140 is reduced to a room temperature, that is, the temperature of installation location of the image forming apparatus. Alternatively, the temperature of the fixing roller 140 may be lowered to the temperature of the interior of the image forming apparatus depending on environmental conditions.

In the fixing device 136 according to the first embodiment, environmental conditions are taken into account to regulate the temperature of the fixing roller 140. Specifically, if the temperature detected by the temperature sensor S is greater than or equal to a predefined degree, the voltage of the capacitor C is reduced to a voltage level lower than a normal voltage level.

FIGS. 9A through 9D are diagrams illustrating exemplary relations between the temperature of the fixing roller 140 and the voltage of the capacitor C.

Figure 9A:
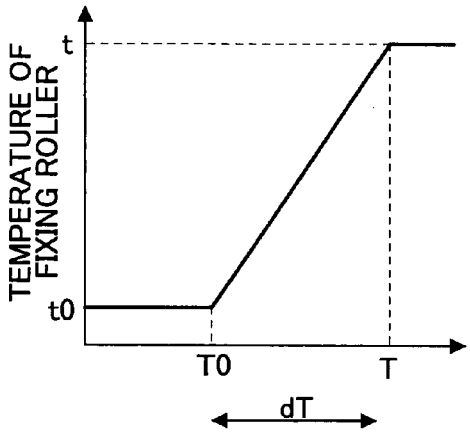
FIGS. 9A through 9D are diagrams illustrating exemplary relations between the temperature of a fixing roller and the voltage of a capacitor according to the first embodiment.

FIG. 9A shows a normal operational mode of the fixing roller 140 according to the first embodiment. Referring to FIG. 9A, the detected temperature of the fixing roller 140 is around the room temperature t0 before the start up time of the image forming apparatus. During the start up time, electric power is fully supplied from the capacitor C to the auxiliary heat generation part 102*b* so as to raise the temperature of the fixing roller 140 to a predefined degree t quickly.

Figure 9B:
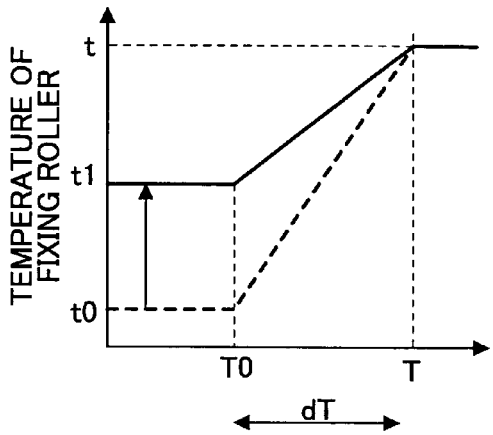

FIG. 9B shows an exemplary lower voltage operational mode of the fixing roller 140 according to the first embodiment. Referring to FIG. 9B, the detected temperature t1 of the fixing roller 140 is higher than the room temperature t0, and thus the capacitor C does not have to fully supply electric power to the auxiliary heat generation part 102*b* during the start up time of the image forming apparatus.

Figure 9C:
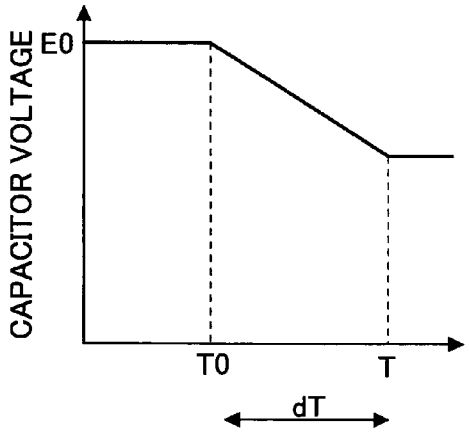
Figure 9D:
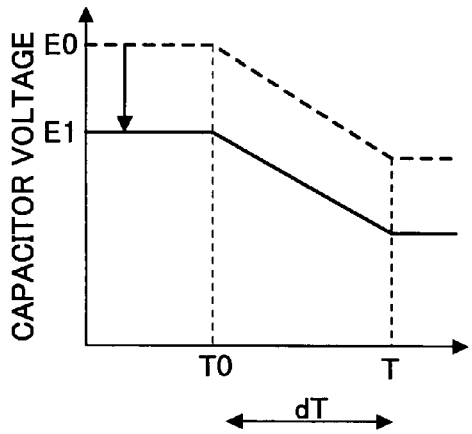

FIGS. 9C and 9D are diagrams illustrating exemplary voltage variations of the capacitor C in the normal operational mode in FIG. 9A and the lower voltage operational mode in FIG. 9B, respectively.

In order to raise the temperature of the fixing roller 140 from a waiting temperature to a fixing temperature, the fixing roller 140 can reach the fixing temperature by using a lower voltage E1 of the capacitor C in the status illustrated in FIG. 9D than FIG. 9C. It is noted that the dot line in FIG. 9D corresponds to the solid line in FIG. 9C. Also, the horizontal axes represent time axes throughout FIGS. 9A to 9D. Also, time points T and T0 and the time interval dT represent the same quantities throughout FIGS. 9A to 9D.

Assuming that the fixing roller 140 has invariant thermal characteristics in terms of a heat capacity and others, voltages E0 and E1 and temperatures t0 and t1 of the capacitor C meet the following formula;

$$E1=E0\times\{(T-T1)/(T-T0)\}^{1/2}.$$

Transforming the formula, the following equation is obtained;

$$(E1/E0)^2=(T-T1)/(T-T0).$$

This equation represents a degree of voltage reduction of the capacitor C. Based upon the equation and the above-mentioned experience that the life-span of the capacitor C is doubled by reduction corresponding to 0.1 V/cell, the voltage of the capacitor C may be determined suitably. It is noted that the output voltage of the capacitor C can be adjusted in accordance with various known methods. The output voltage may be continuously changed. Alternatively, a plurality of setting values are provided for the output voltage, and any of the setting values may be selected. Obviously, if the capacitor C is controlled in the above fashion, the capacitor C has a voltage other than the maximum thereof.

Alternatively, an operational mode of the image forming apparatus can be used instead of the temperature of the fixing roller 140 to adjust and control the voltage of the capacitor C.

Figure 10:
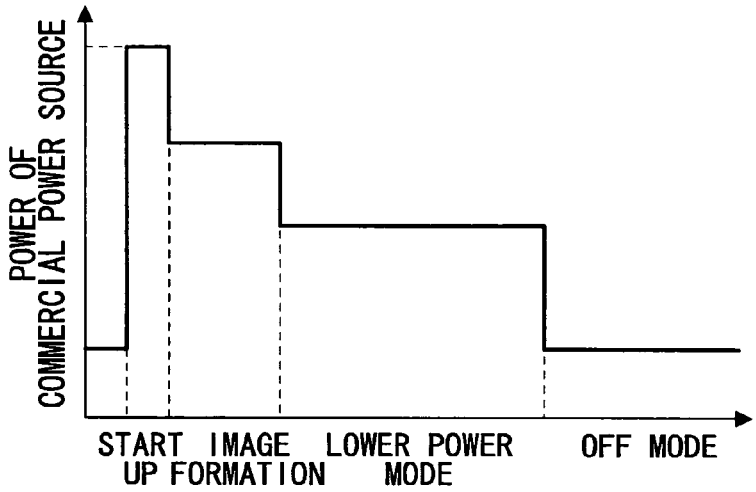
FIG. 10 is a diagram illustrating an exemplary variation of electric power supplied from a commercial power source to an image forming apparatus depending on operational modes of the image forming apparatus according to the first embodiment.

FIG. 10 is a diagram illustrating an exemplary variation of electric power supplied from a commercial power source to the image forming apparatus depending on operational modes of the image forming apparatus.

Referring to FIG. 10, after image formation, the image forming apparatus proceeds to a lower power mode, and then if the next image formation is not performed during a predefined time interval, the image forming apparatus proceeds to an off-mode. The lower power mode and the off-mode belong to a so-called save-mode. If the save mode is found based on detection of electric power of the commercial power source, the voltage of the capacitor C is lowered similarly to the above-mentioned fashion of the temperature sensor S.

Figure 11A:
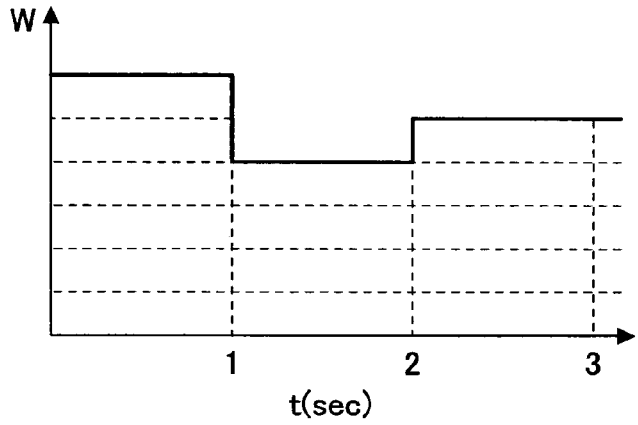
FIGS. 11A and 11B are diagrams illustrating an example of increase and decrease in average electric power per unit time supplied to the heating device shown in FIG. 4.
Figure 11B:
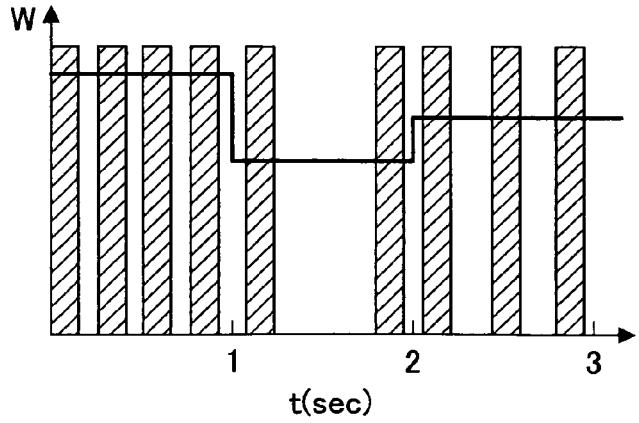

FIGS. 11A and 11B are diagrams illustrating examples to increase or decrease an amount of average electric power supplied to the heating device 101 per unit time.

According to the fixing device 136 having the above-mentioned structure, in a case where an amount of electric power supplied from the auxiliary power source device 104 to the auxiliary heat generation part 102*b*, the amount of electric power is adjusted by changing timing of stopping the supplied electric power as mentioned above. Alternatively, the amount of electric power may be stopped by increasing and decreasing an mount of average supplied electric power per unit time after start of supplying electric power from the auxiliary power source device 104 to the auxiliary heat generation part 102*b*, as illustrated in FIGS. 11A and 11B. In FIG. 11B, an amount of electric power supplied to the auxiliary heat generation part 102*b* is controlled by alternating the ON/OFF period thereof. Alternatively, the heating part 102 may be configured to include a plurality of auxiliary heat generation parts having different rated consumed electric powers. In such a structure, the control part 108 can increase or decrease the amount of average supplied electric power per unit time by switching the plurality of auxiliary heat generation parts timely.

In the above-mentioned structure, the nip part N is formed between the fixing roller 140 and the pressure roller 141. However, the present invention is not limited to the structure. The nip part N may be formed by a pair of a roller and a belt or another pair of two belts as long as the recording medium P can pass in close vicinity of the heating part. In addition, the present invention is not limited to the illustrated type of image forming apparatus. For example, the photoconductor may have a belt type body rather than a drum-shaped body. Also, the present invention is applicable to various types of image forming apparatuses such as a color image forming apparatus using an intermediate transferring belt.

According to the first embodiment, the heating device includes a temperature detection part to detect the temperature around a portion heated with use of an electricity storage device (capacitor), and if the detected temperature is higher than or equal to a predefined temperature, the capacitor is controlled in such a way that the output voltage of the electricity storage device becomes lower than the maximum thereof. As a result, it is possible to improve the life-span of the capacitor.

A fixing apparatus according to a second embodiment of the present invention is described.

Figure 12:
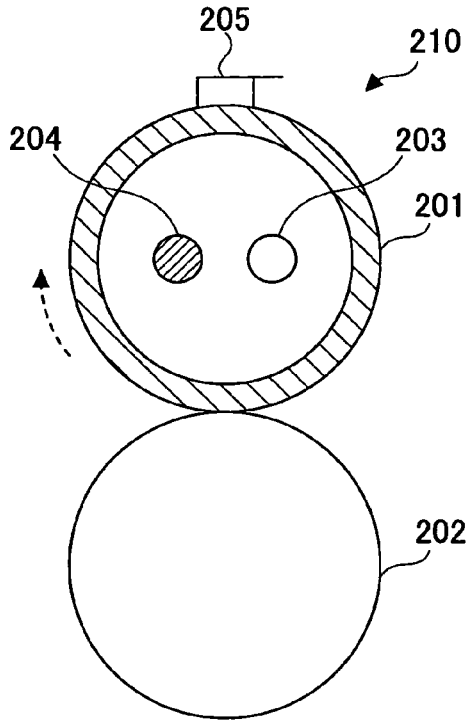
FIG. 12 is a cross-sectional view showing an exemplary structure of a fixing device according to a second embodiment of the present invention.

FIG. 12 is a cross-sectional view showing an exemplary structure of a fixing device according to the second embodiment.

Referring to FIG. 12, a fixing device 210 comprises a fixing roller 201, a pressure roller 202 and a temperature detection part 205. The fixing roller 201 is heated by heaters 203 and 204 as embodiments of heat generation parts, and rotates clockwise with respect to the illustration in FIG. 12. The pressure roller 202 applies constant nip pressure to the fixing roller 201, and rotates counterclockwise with respect to the illustration in FIG. 12. The temperature detection part 205 is in contact with the fixing roller 201, and detects the surface temperature of the fixing roller 201.

The fixing roller 201 is often configured to have a hollow cylinder shape, but may be configured as a belt having no edge.

The pressure roller 202 is often configured as a cylinder-shaped roller whose surface is made of an elastic member such as a silicon rubber, but may be configured as a belt having no edge. A pressure part (not illustrated) applies constant pressure in the direction toward the fixing roller 201 to the pressure roller 202 so as to press the pressure roller 202 to the fixing device 201. The fixing roller 201 and the pressure roller 202 are rotationally-driven by a drive mechanism (not illustrated).

The heaters 203 and 204 are disposed in the interior of the hollow cylinder of the fixing roller 201. Alternatively, the heaters 203 and 204 may be configured as sheet type heaters, and each of the heaters 203 and 204 may be disposed such that the heater 203 or 204 covers the upper portion of the fixing roller 201.

The heater 203 generates heat by receiving electric power from an external power source such as a commercial alternate power source, and heats the fixing roller 201 by using radiant heat thereof.

The heater 204 generates heat by receiving electric power from an electricity storage device, and heats the fixing roller 201 by using radiant heat thereof.

The heaters 203 and 204 are not limited to the above-mentioned type, as long as the heaters 203 and 204 are configured to heat the fixing roller 201 by using supplied electric power. Also, the heaters 203 and 204 can be arbitrarily positioned as long as the heaters 203 and 204 can heat the fixing roller 201.

The temperature detection part 205 can be configured as contact or non-contact type radiation thermometer and thermocouple thermometer, as long as the thermometer can detect the surface temperature of the fixing roller 201. It is noted that the fixing device 210 follows a conventional toner fixing method of fixing a toner on a sheet.

Figure 13:
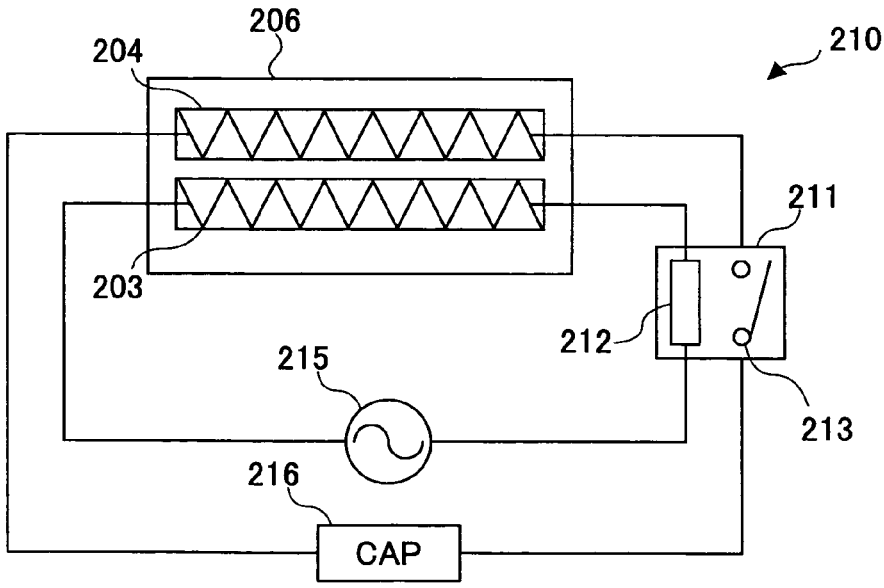
FIG. 13 is a circuit diagram of an exemplary circuit structure of a fixing device according to the second embodiment.

FIG. 13 shows an exemplary circuit structure of a fixing device according to the second embodiment. In FIG. 13, only a circuit portion involved in power supply to the heaters 203 and 204 is illustrated.

Referring to FIG. 13, the fixing device 210 comprises a heat generation part 206 having the heaters 203 and 204, a power control part 211 having a driver 212 to adjust an amount of electric power supplied to the heater 203 and a switch 213 to adjust an amount of electric power supplied to the heater 204, an external power source 215 such as a commercial alternate power source, and a capacitor 216 as an embodiment of an electricity storage device. The heater 203 generates heat by using electric power supplied from the external power source 215, and the heater 204 generates heat by using electric power supplied from the capacitor 216.

The heater 203 is connected to the external power source 215 via the driver 212. The power control part 211 controls the driver 212 to control an amount of electric power supplied from the external power source 215 to the heater 203.

The heater 204 is connected to the capacitor 216 via the switch 213 and receives an amount of electric power corresponding to a remaining capacity of the capacitor 216. The power control part 211 controls an amount of electric power supplied from the capacitor 216 to the heater 204 by switching of the switch 213. Specifically, when the switch 213 is ON during activation of the heater 204, a current discharged from the capacitor 216 is supplied to the heater 204. On the other hand, when the switch 213 is OFF, no current is supplied to the heater 204 and the capacitor 216 is charged by a connected charge device (not illustrated).

Depending upon statuses of the fixing device 210, the power control part 211 adjusts an amount of electric power supplied from the external power source 215 to the heater 203 via the driver 212 and an amount of electric power supplied from the capacitor 216 to the heater 204 via the switch 213. Specifically, by controlling the driver 212, the power control part 211 can start and stop power supply from the external power source 215 as well as adjust an amount of the supplied electric power. In addition, by controlling the switch 213, the power control part 211 can start and stop power supply from the capacitor 216. It is noted that the status of the fixing device 210 is determined, for example, based on an ON-OFF signal of the main power source and temperature information of the fixing roller 201 obtained from the temperature detection part 205. The statuses, such as "starting up", "waiting" and "paper passing", can be recognized for the fixing device 210.

It is preferable that the capacitor 216 be configured from an electricity storage device having an electrostatic capacity larger than farad order, such as an electric double layer capacitor.

Figure 14:
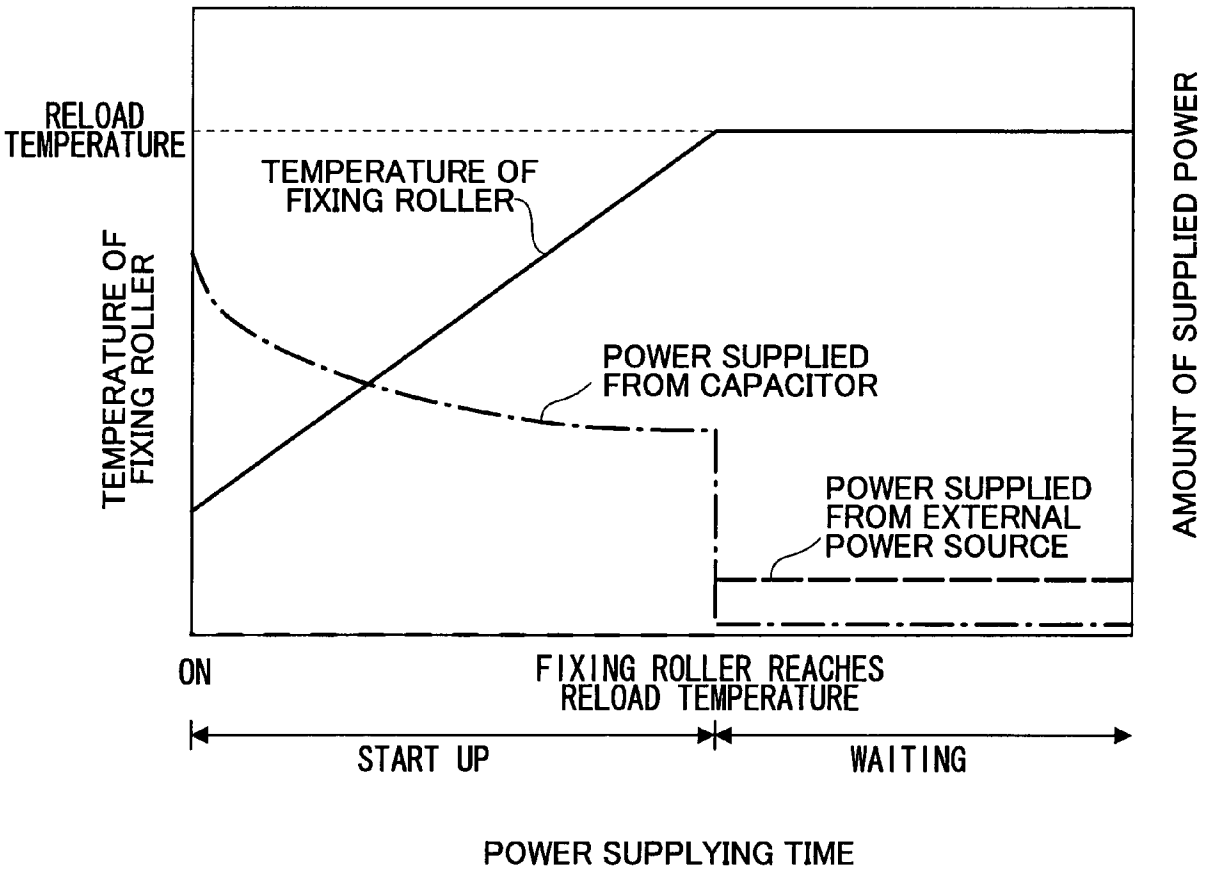
FIG. 14 is a diagram illustrating exemplary relations among power supplying time, power supply quantities and fixing roller temperatures of a fixing device during start up time thereof according to the second embodiment.

FIG. 14 shows an exemplary relation among power supplying time, supplied power quantities and fixing roller temperatures at start up time of the fixing device 210.

A description is given, with reference to FIG. 12 through FIG. 14, of an exemplary operation involved in power supply at start up time.

At step S211, in response to switching ON of the main power source, the power control part 211 uses the driver 212 to stop power supply to the heater 203 and switches ON the switch 213.

At step S212, power supply from the capacitor 216 to the heater 204 is started. At this time, no electric power from the external power source 215 is consumed.

At step S213, the heater 204 generates heat, thereby raising the temperature of the fixing roller 201.

At step S214, the temperature detection part 205 monitors for the temperature of the fixing roller 201, and detects that the temperature reaches a reload temperature at which a toner can be fixed.

At step S215, in response to the detection that the temperature of the fixing roller 201 has reached the reload temperature, the power control part 211 switches OFF the switch 213, and instructs the driver 212 to supply electric power from the external power source 215 to the heater 203.

At step S216, the power supply to the heater 204 is stopped, and the power supply from the external power source 215 to the heater 203 is started.

At step S217, based upon temperature information on the fixing roller 201 detected by the temperature detection part 205, the power control part 211 uses the driver 212 to adjust an amount of electric power supplied from the external power source 215, and the fixing device 201 moves to the status "waiting" in a condition where the reload temperature is kept.

In this fashion, while electric power is supplied from only the electricity storage device 216 to the heat generation part 204, any electric power does not have to be supplied from the external power source 215, and the fixing device 210 does not consume electric power from the external power source 215 at all. As a result, it is possible to lower the maximum power used for the fixing device 210 from the external power source 215. This is more effective, especially, in a case where a larger amount of electric power is required, for example, at start up time of the fixing device 210.

In addition, when the fixing device 210 makes intensive use of the capacitor 216, the capacitor 216 can be sufficiently discharged, thereby reducing the cell voltage of the capacitor. As a result, it is possible to make the life-span of the capacitor longer. Furthermore, when the fixing device 210 consumes electric power supplied from the electricity storage device 216, unnecessary electric power cannot remain in the electricity storage device 216. As a result, it is possible to efficiently consume electric power supplied from the external power source 215.

Here, the above description is involved in the case where the capacitor 216 stores an amount of electric power enough to heat the fixing roller 201 to the reload temperature. On the other hand, if the capacitor 216 does not store a sufficient amount of electric power, electric power may be supplied from the external power source 215 and the capacitor 216 to the heaters 203 and 204 simultaneously. Alternatively, electric power is first supplied from only the capacitor 216 to the heater 204, and when the capacity of the capacitor 216 is used up, power supply from the external power source 215 to the heater 203 is started to continue raising the temperature of the fixing roller 201. In this case, a capacitor remainder detection part is further provided to monitor for the remaining capacity of the capacitor 216.

Figure 15:
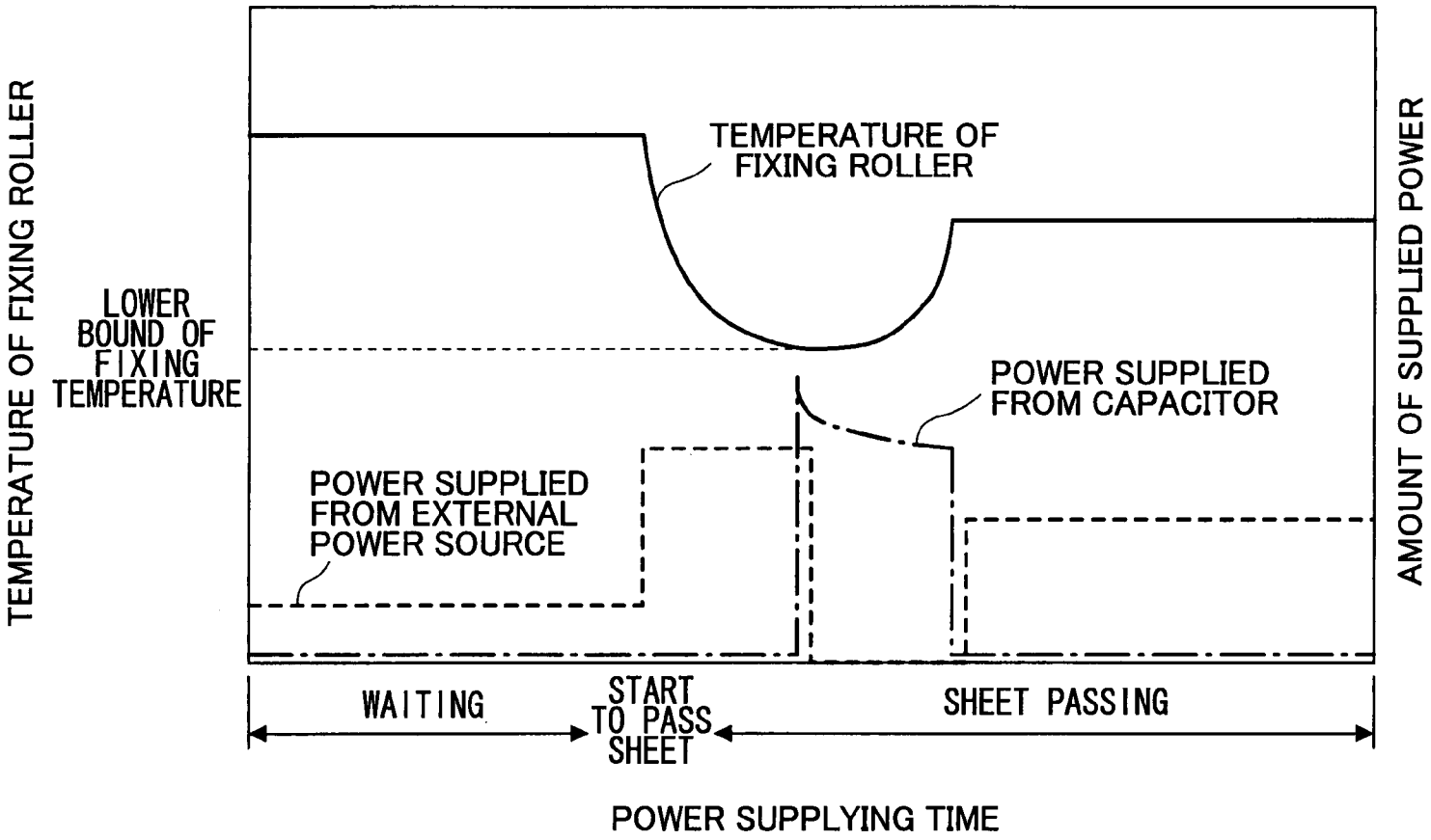
FIG. 15 is a diagram illustrating exemplary relations among power supplying time, power supply quantities and fixing roller temperatures of a fixing device during sheet passage time thereof according to the second embodiment.

A description is given, with reference to FIG. 12, FIG. 13 and FIG. 15, of an exemplary operation involved in power supply in a case where the status of the fixing roller 201 moves from the waiting status, in which the temperature of the fixing roller 201 is kept at the reload temperature, to the sheet passing status.

FIG. 15 shows an exemplary relation among power supplying time, supplied power quantities and fixing roller temperatures at sheet passing time of the fixing device 210.

Referring to FIG. 15, toner adhesive sheets are started to be successively carried toward the fixing roller 201 at step S221.

At step S222, the power control part 211 uses the driver 212 to increase an amount of electric power supplied from the external power source 215 to the heater 203 at the same time as step S221.

At step S223, the temperature of the fixing roller 201 starts to fall.

At step S224, the temperature detection part 205 monitors for the temperature of the fixing roller 201, and detects that the temperature has reached a lower bound of the fixing temperature.

At step S225, in response to the detection, the power control part 211 uses the driver 212 to stop supplying electric power from the external power source 215 to the heater 203, and at the same time switches ON the switch 213.

At step S226, the power supply to the heater 203 is stopped, and the power supply from the capacitor 216 to the heater 204 is started. At this time, an amount of electric power consumed from the external power source 215 becomes 0 W.

At step S227, the heater 204 generates heat to raise the temperature of the fixing roller 201.

At step S228, when the temperature detection part 205 detects that the fixing roller 201 has been heated to a predefined temperature, the power control part 211 switches OFF the switch 213, and at the same time uses the driver 212 to start power supply from the external power source 215 to the heater 203.

At step S229, the power supply to the heater 204 is stopped, and then the power supply from the external power source 215 to the heater 203 is started.

At step S230, based on temperature information on the fixing roller 201 detected by the temperature detection part 205, the power control part 211 adjusts an amount of electric power supplied from the external power source 215 via the driver 212, and balances and maintains the temperature of the fixing roller 201 under the sheet passing status within a predefined fixable temperature range.

In this fashion, even if a large amount of electric power has to be supplied to the fixing device 210 due to the decrease in the temperature of the fixing roller 201 during the sheet passage, the electric power is preferentially supplied from the capacitor 216. As a result, it is possible to efficiently use electric power from the external power source 215 and lower the maximum power used from the external power source 215.

Figure 16:
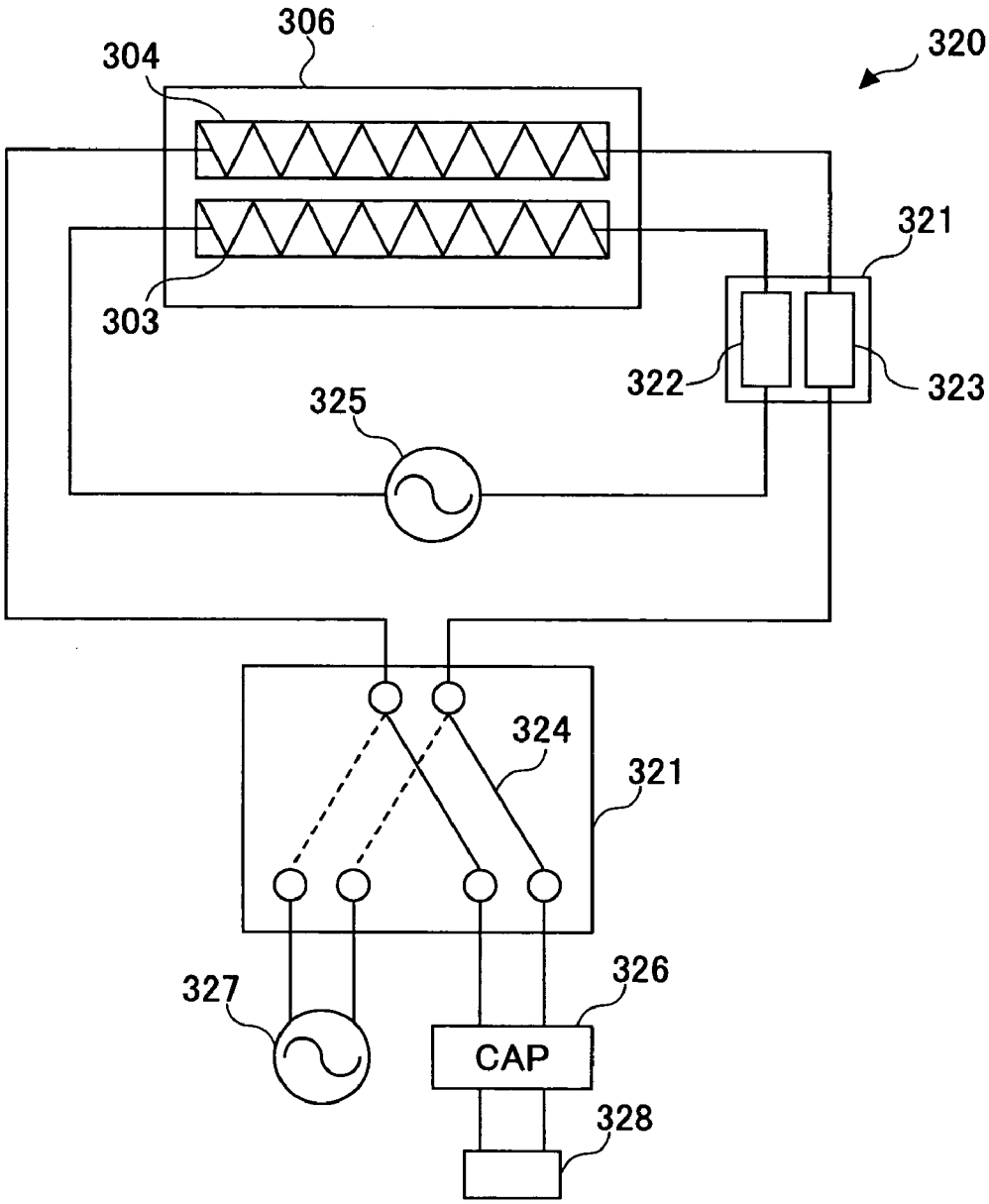
FIG. 16 is a circuit diagram of an exemplary circuit structure of another fixing device according to the second embodiment.
Figure 17:
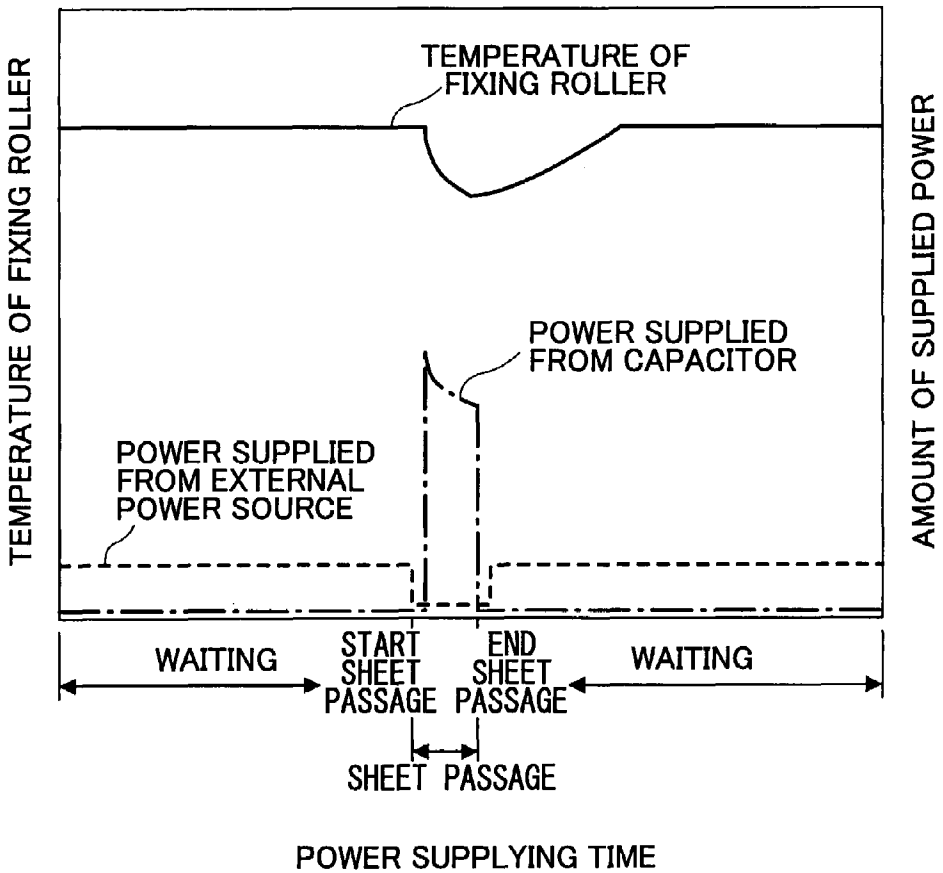
FIG. 17 is a diagram illustrating exemplary relations among power supplying time, power supply quantities and fixing roller temperatures of a fixing device during sheet passage time thereof in a case of a small parameter according to the second embodiment.
Figure 18:
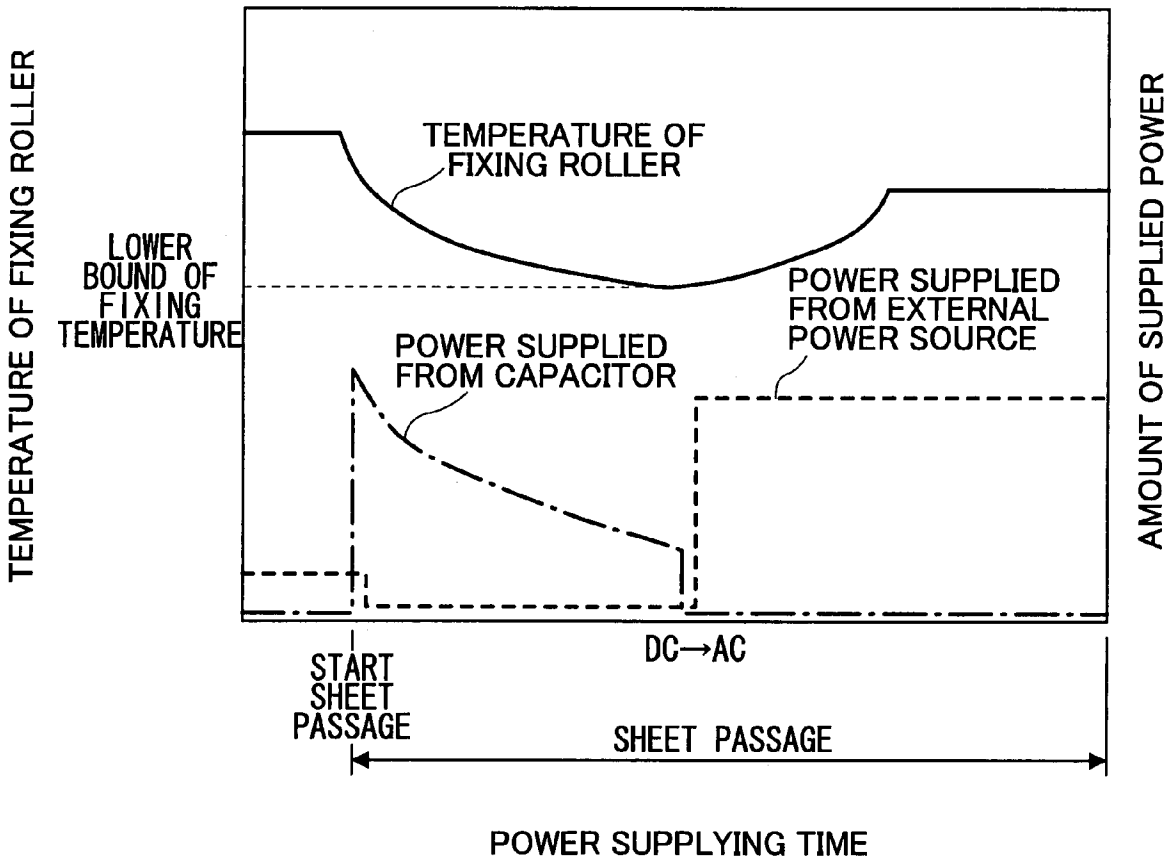
FIG. 18 is a diagram illustrating exemplary relations among power supplying time, power supply quantities and fixing roller temperatures of a fixing device during sheet passage time thereof in a case of a large parameter according to the second embodiment.

A description is given, with reference to FIG. 16 through FIG. 18, of another exemplary fixing device according to the second embodiment. It is noted that the fixing device 320 has the same cross-sectional structure as the fixing device 210 shown in FIG. 12.

FIG. 16 shows an exemplary circuit structure of an exemplary fixing device 320 according to the second embodiment. In FIG. 16, only a circuit portion involved in power supply to the heaters 303 and 304 is illustrated.

Referring to FIG. 16, the fixing device 320 comprises a heat generation part 306, a power control part 321, external power sources 325 and 327, a capacitor 326, and a remainder detection part 328. The heat generation part 306 comprises heaters 303 and 304 having the same configuration as the heaters 203 and 204. The power control part 321 comprises a switch 324 to switch power sources of a driver 322 to adjust an amount of electric power supplied to the heater 303 and a driver 323 to adjust an amount of electric power supplied to the heater 304. The external power sources 325 and 327 are configured, for example, from commercial alternate current power sources. The capacitor 326 is an embodiment of an electricity storage device. The remainder detection part 328 detects an remaining capacity of the capacitor 326.

The heater 303 generates heat by using electric power supplied from the external power source 325. The heater 304 generates heat by using electric power supplied from the capacitor 326 or the external power source 327. It is noted that the heaters 303 and 304, the driver 322, the external power sources 325 and 327, and the capacitor 326 have the same configuration as the heater 203 and 204, the driver 212, the external power source 215, and the capacitor 216, respectively.

The power control part 321 has a first mode and a second mode. In the first mode, electric power is not supplied from the external power source 325 to the heater 303, and the heating part 306 is heated by using supplying electric power from the capacitor 326 to the heater 304. In the second mode, electric power is not supplied from the capacitor 326 to the heater 304, and the heating part 306 is heated by using electric power from the external power source 325 to the heater 303. The power control part 321 comprises a selection part to alternately switch the first and second modes depending on statuses of the fixing device 320.

Specifically, if the selection part selects the first mode, the power control part 321 uses the switch 324 to select the capacitor 326, and controls the driver 323 to start power supply from the capacitor 326. Here, if the remaining amount of the capacitor 326 is zero or nearly zero, the power control part 321 may control the driver 323 to adjust an amount of electric power supplied from the external power source 327 and supply the adjusted electric power after selection of the external power source 327.

On the other hand, if the selection part selects the second mode, the power control part 321 controls the driver 322 to start power supply from the external power source 325 and adjusts an amount of the supplied electric power.

It is noted that the statuses of the fixing device 320 are determined, for example, based on an ON-OFF signal of the main power source, parameter information such as the number of copies, temperature information on the fixing roller 201 detected by the temperature detection part 205, and remainder information on the capacitor 326 detected by the remainder detection part 328. Through the statuses, the starting up status, the waiting status, the sheet passing status, and the status where an amount of electric power supplied from the capacitor 326 reaches a predefined lower bound are recognized.

The remainder detection part 328 measures the voltages of both ends of the capacitor 326. Based upon correlation between the voltage and remaining capacity of the capacitor 326 obtained from the detected voltages, the remainder detection part 328 can find the remaining amount of the capacitor 326.

FIG. 17 shows an exemplary relation among power supplying time, amounts of supplied electric power, and temperatures of the fixing roller 201 of the fixing device 320 during sheet passage in a case where a parameter, such as the number of copies, has a small value.

A description is given, with reference to FIG. 12, FIG. 16 and FIG. 17, of an exemplary operation involved in power supply when a sheet passes through the fixing device 320 under the waiting status where the temperature of the fixing roller 201 is maintained at a reload temperature. In the first waiting status in the illustration, the power control part 321 selects the second mode, and a predefined amount of electric power is supplied from the external power source 325 to the heater 303.

Referring to FIG. 17, a successive sheet passage operation to pass toner adhesive sheets successively is started at step S231.

At step S232, the power control part 321 uses the selection part to switch the current mode from the second mode to the first mode at the same time as step S231.

At step S233, the temperature of the fixing roller 201 starts to drop.

At step S234, in response to the switching into the first mode, the power supply to the heater 303 is stopped, and the power supply from the capacitor 326 to the heater 304 is started. At this time, no electric power is consumed from the external power source 327.

At step S235, the heater 304 generates heat to prevent the temperature drop of the fixing roller 201.

At step S236, the sheet passage operation is terminated.

At step S237, in parallel with step S236, the power control part 321 uses the selection part to switch the current mode from the first mode to the second mode.

At step S238, in response to the switching into the second mode, the power supply to the heater 304 is stopped, and the power supply from the external power source 325 to the heater 303 is restarted. Thereby, the fixing roller 201 is heated to a predefined temperature, and the fixing device 320 comes into the waiting status.

According to the above-mentioned operation, if the temperature of the fixing roller 201 less drops during sheet passage through the fixing device 320 because of the small parameter (the small number of copies), the power supply from only the capacitor 326 can prevent temperature decrease of the fixing roller 201. As a result, it is possible to efficiently use electric power from an external power source and reduce the maximum power used for the fixing device 320 in the external power source.

A description is given, with reference to FIG. 12, FIG. 16 and FIG. 18, of an exemplary operation involved in power supply in a case where a parameter such as the number of copies has a large value.

FIG. 18 shows an exemplary relation among power supplying time, amounts of supplied power, and temperatures of the fixing roller 320 during sheet passage in the case of a large parameter. In the illustration, in the first waiting status, the power control part 321 selects the second mode and a predefined amount of electric power is supplied from the external power source 325 to the heater 303.

Referring to FIG. 18, a successive sheet passage operation to successively pass toner adhesive sheets through the fixing device 320 is started at step S241.

At step S242, the power control part 321 uses the selection part to switch the current status from the second mode to the first mode in the same time as step S241.

At step S243, the temperature of the fixing roller 201 starts to drop.

At step S244, in response to the switching into the first mode, the power supply to the heater 303 is stopped, and the power supply from the capacitor 326 to the heater 304 is started. At this time, no electric power is consumed in the external power source 327.

At step S245, the heater 304 generates heat to prevent temperature drop of the fixing roller 201.

At step S246, the remainder detection part 321 detects that the remaining amount of the capacitor 326 has dropped to a lower bound of the remaining capacity thereof.

At step S247, based on the detection result at step S246, the power control part 321 switches the current power source to supply electric power to the heater 304 from the capacitor 326 to the external power source 327.

At step S248, based on temperature information on the fixing roller 201 detected by the temperature detection part 205, the power control part 321 regulates an amount of electric power supplied from the external power source 327 via the driver 323, and balances and maintains the temperature of the fixing roller 201 within a fixable temperature range under the sheet passing status.

According to the above-mentioned operation, if a large amount of electric power is required because of a huge drop of the temperature of the fixing roller 201, for example, due to sheet passage with a large parameter (the large number of copies), electric power is first supplied from the capacitor 326 preferentially, and then from the external power source 327 after exhaustion of the capacitor 326. As a result, it is possible to efficiently use electric power supplied from the external power source 327 and reduce the maximum power used for the fixing device 320 in the external power source 327. Also, when electric power stored in the capacitor 326 is intensively exhausted, it is possible to shorten a period during which the capacitor 326 is maintained at a high voltage. As a result, it is possible to make the life-span of the capacitor 326 longer and use the capacitor 326 in a longer time period.

Accordingly, since the fixing device 320 can selectively use some power supply sources by selecting an appropriate mode depending on statuses thereof, the fixing roller 201 can be heated by efficiently consuming electric power stored in the capacitor 326. As a result, it is possible to prevent unnecessary power consumption. In a conventional power supply method, for example, even if the capacitor 326 is charged from an external power source and stores sufficient electric power, electric power is supplied from both of the external power source 325 and the capacitor 326 to the heaters 303 and 304, respectively. Accordingly, electric power supplied from the external power source 325 is unnecessarily consumed. However, the fixing device 320 can prevent unnecessary power consumption.

Figure 1:
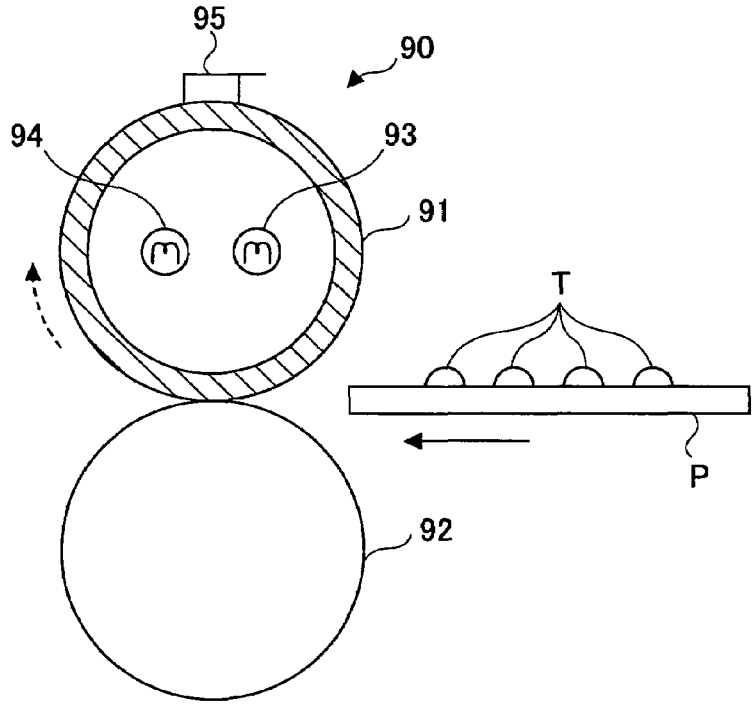
FIG.1 PRIOR ART
FIG. 1 is a cross-sectional view showing an exemplary structure of a conventional fixing device.
Figure 2:
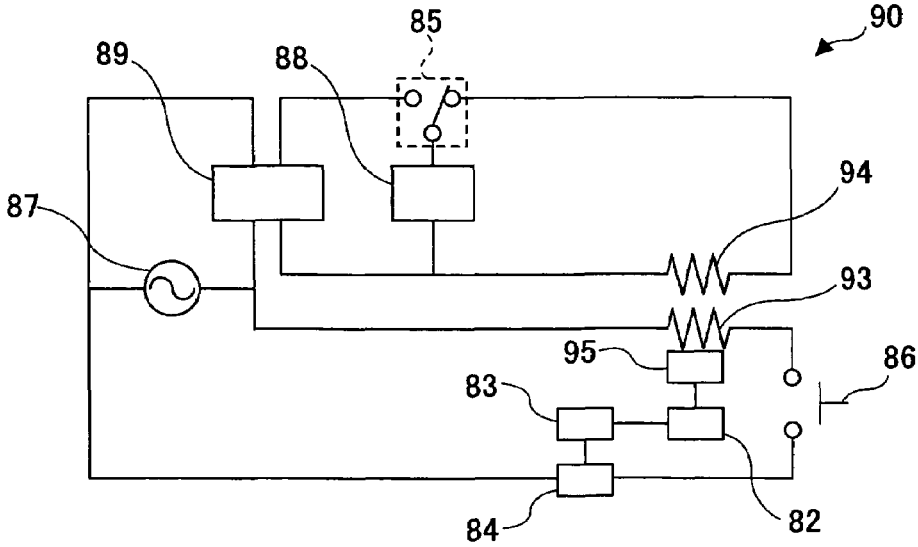
FIG.2 PRIOR ART
FIG. 2 shows an exemplary circuit structure of a conventional fixing device.
Figure 3:
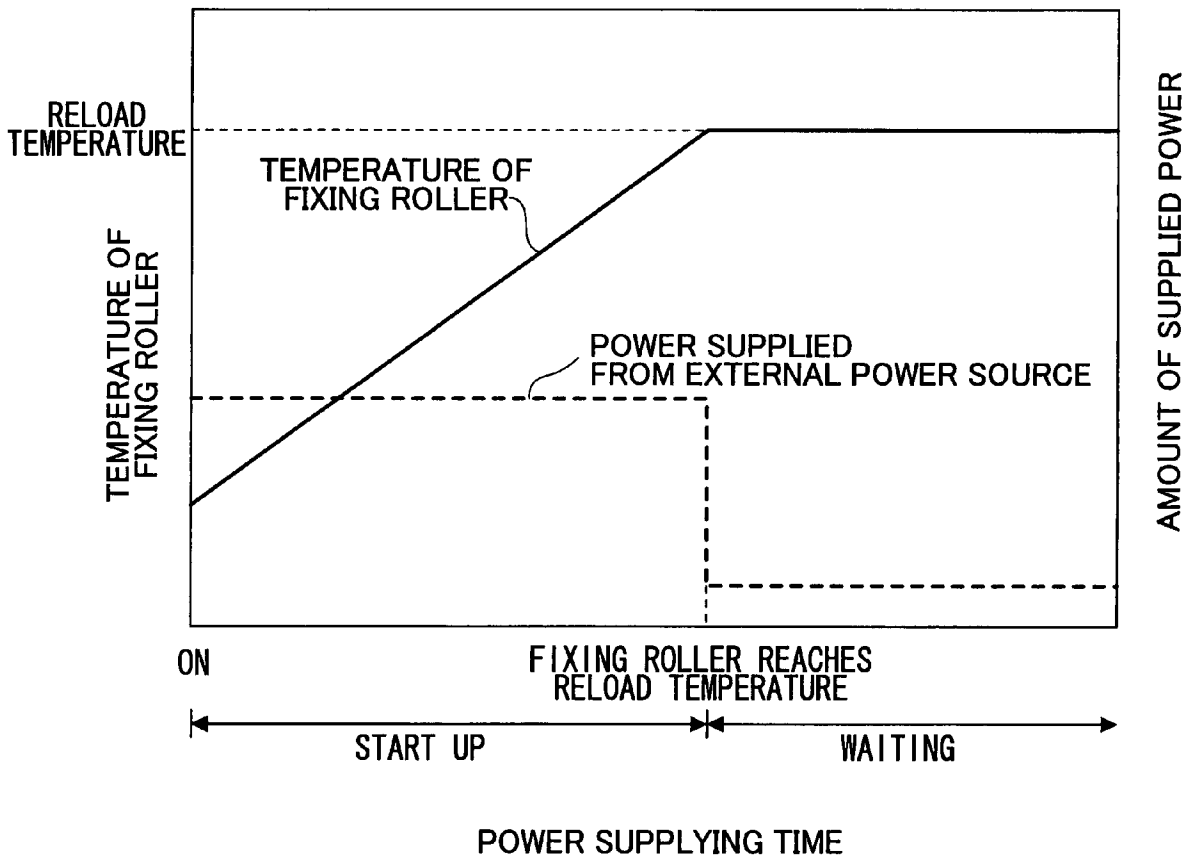
FIG.3 PRIOR ART
FIG. 3 is a diagram illustrating exemplary relations among power supplying time, power supply quantities and fixing roller temperatures of a conventional fixing device.

In addition, electric power can be supplied from any power supply source of an electricity storage device and an external power source to one or more heat generation parts. Accordingly, the power supply sources can be selectively used depending on statuses of the fixing device. As a result, it is possible to provide a fixing device that can lower the maximum power used in an external power source and prevent unnecessary power consumption. For example, when a conventional fixing device is started up, a considerable amount of electric power is being supplied from an external power source to the fixing device for the purpose of rapid heating of the fixing roller until the temperature of the fixing roller reaches a reload temperature, as illustrated in FIG. 3. As a result, since the maximum power used for the fixing device becomes high, there is a risk that other devices can limitedly use the power source due to occupancy of the capacity of the external power source. According to the second embodiment, however, since the maximum consumption power can be lowered, it is possible to use the external power source for other devices.

In addition, while sheets are successively carried in a conventional fixing device, electric power is first supplied from an external power source to a heater so as to prevent a temperature drop of the fixing roller due to heat absorption into the sheets. Accordingly, the conventional fixing device cannot make effective use of electric power stored in a capacitor. According to the second embodiment, however, since electric power is first supplied from a capacitor to a heater, it is possible to effectively use the electric power stored in the capacitor.

In addition, according to the second embodiment, since a heater can be configured to use an electricity storage device and an external power source in combination as power supply sources thereof, the total number of heaters required in a fixing device can be reduced. As a result, it is possible to save an area for installation of the heaters and improve design flexibility of the fixing device. For example, a conventional fixing device includes different heaters dedicated to capacitors apart from those for an external power source, because the capacitors supply direct current whereas the external power source supplies alternate current. As a result, since the fixing device needs a number of heaters, the fixing device must be designed under such severer constraints because of reservation of location areas of the heaters. According to the second embodiment, this problem can be eliminated.

Figure 19:
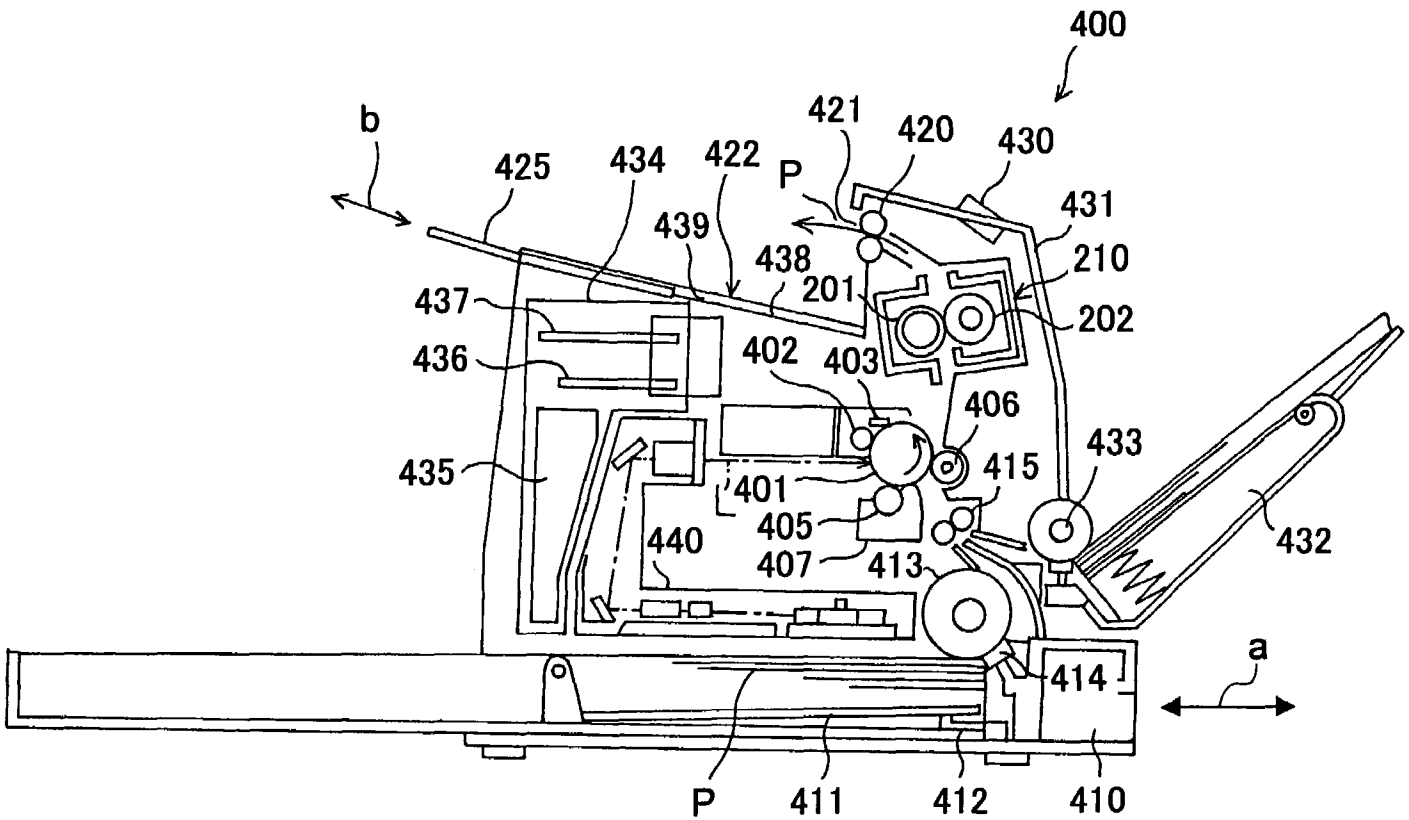
FIG. 19 is a cross-sectional view showing an exemplary structure of an image forming apparatus according to the second embodiment.
Figure 20:
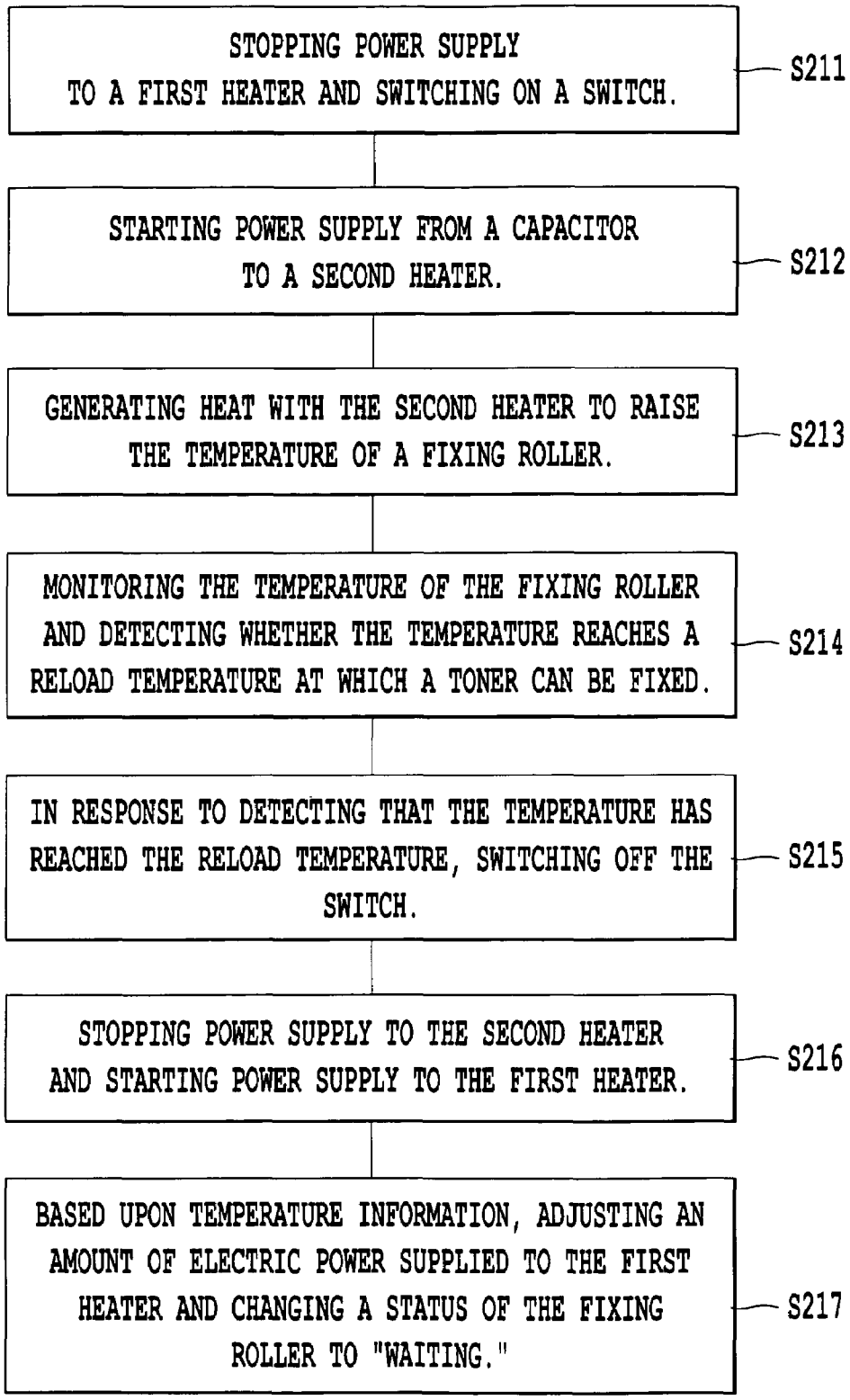
FIGS. 20–23 are flow charts illustrating steps for controlling power supply according to the second embodiment.
Figure 21A:
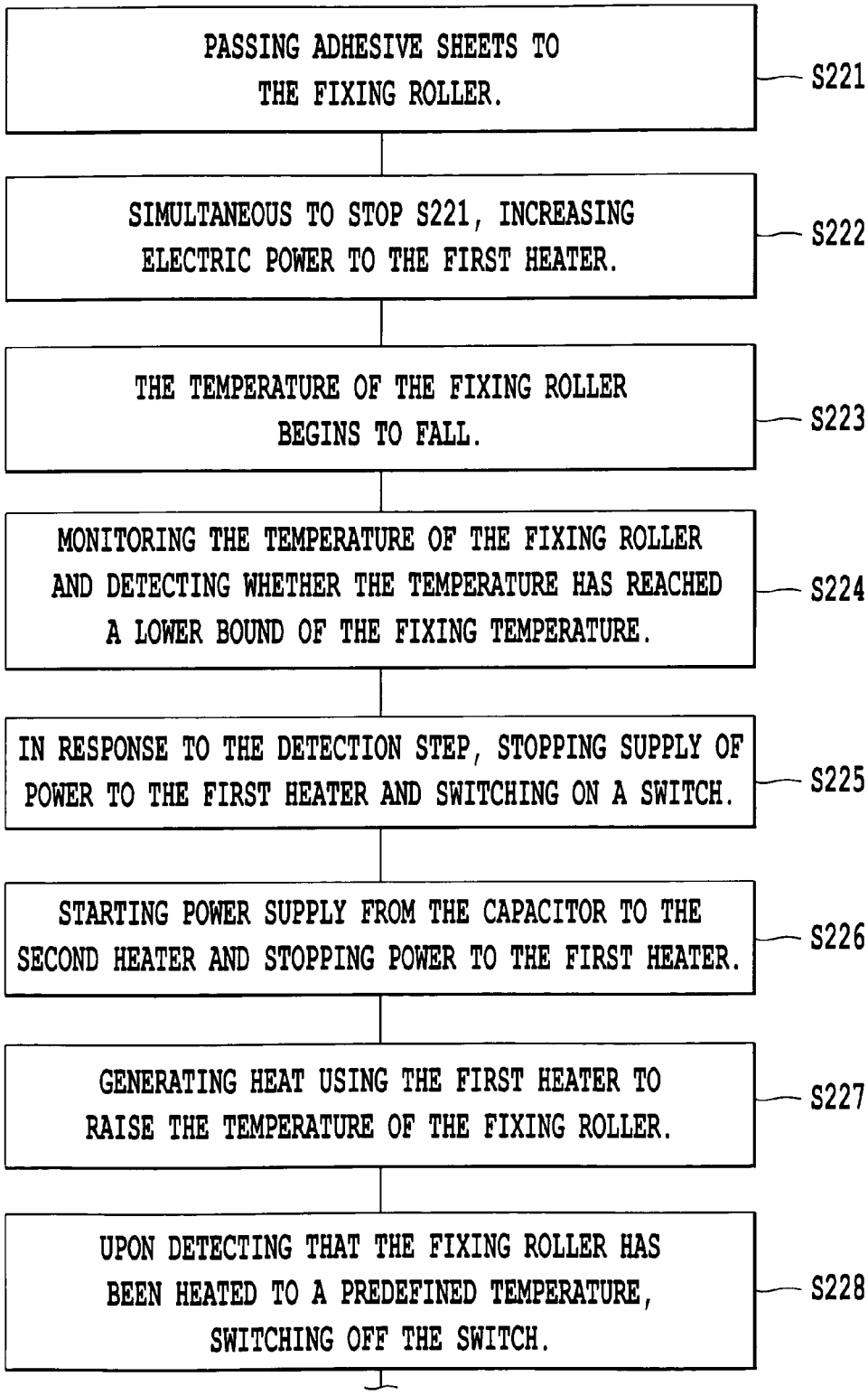
Figure 21B:
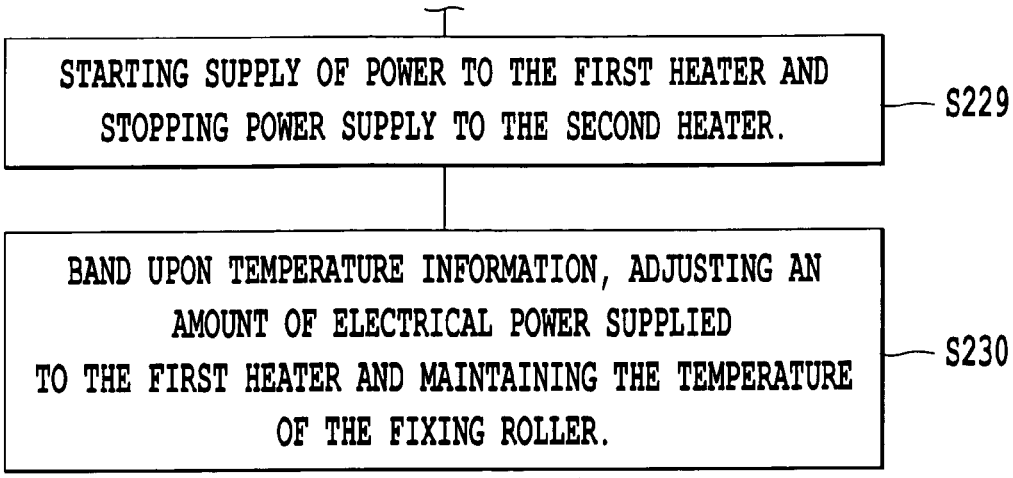
Figure 22:
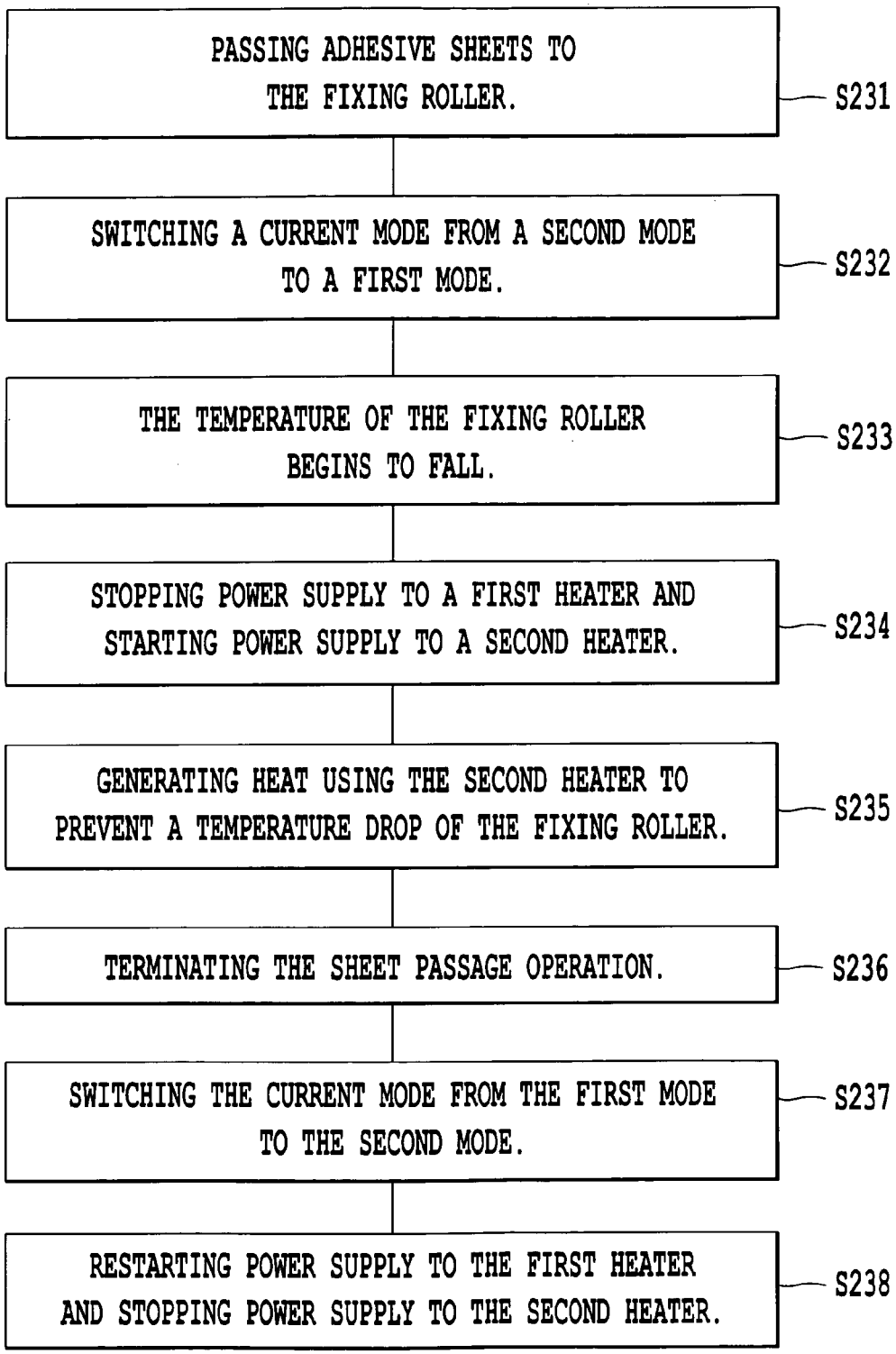
Figure 23:
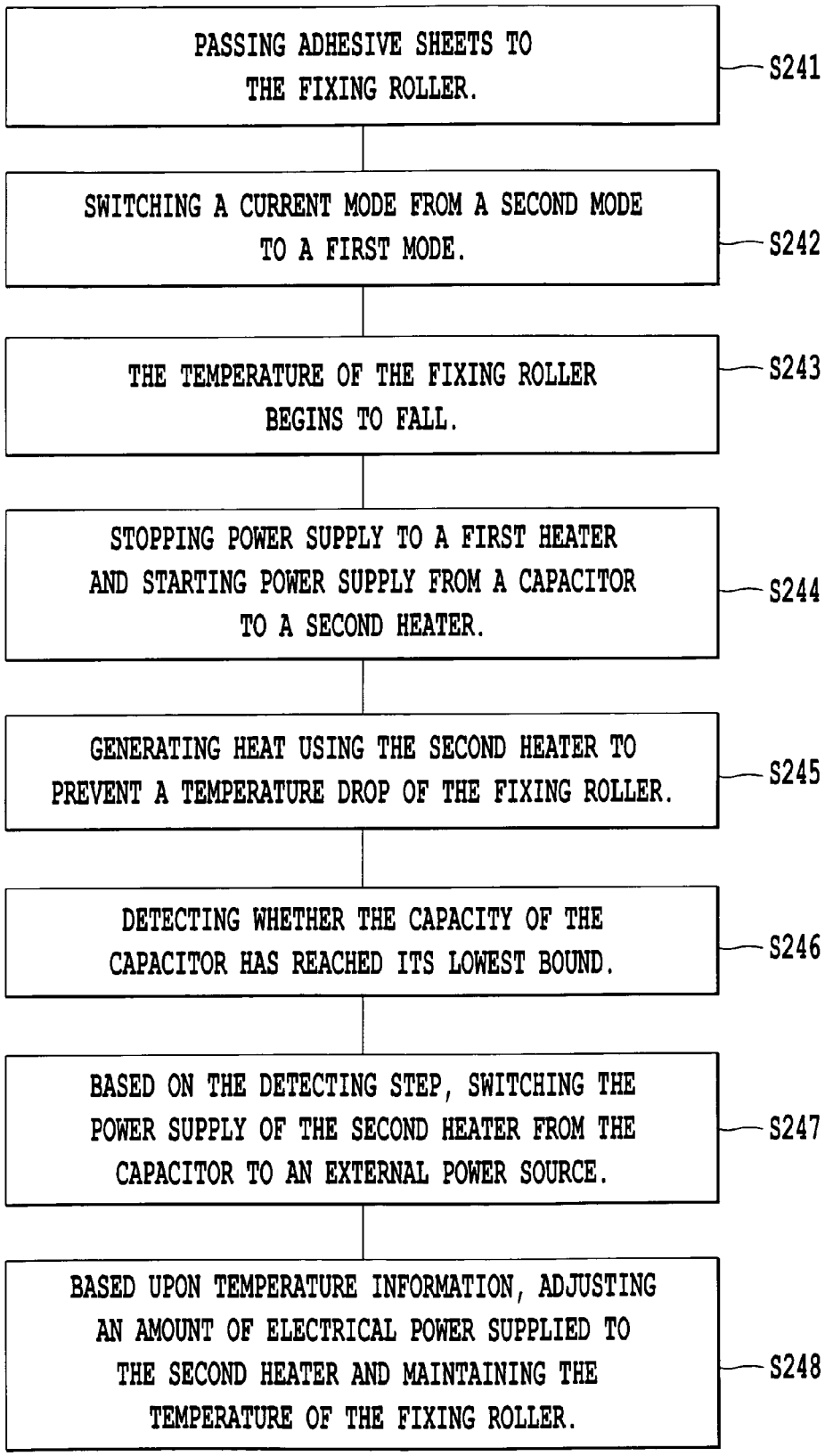

FIG. 19 shows an exemplary structure of an image forming apparatus incorporating the fixing device 210.

Referring to FIG. 19, an image forming apparatus 400 comprises a drum-shaped photoconductor 401 serving as an image support body, an electrifying part 402 to electrify the photoconductor 401 uniformly, a laser optical system 440 to expose the electrified photoconductor 401 to laser light L and form an electrostatic image, and a development part 407 to develop the electrostatic image on the photoconductor 401 to form an toner image, as an electrophotographic mechanism thereof. The toner image on the photoconductor 401 is transferred onto a sheet P supplied from an input paper cassette by a transferring part 406. The toner image formed sheet P is carried to the fixing device 210, and is heated by the fixing roller 201 and the pressure roller 202. Through this operation, the toner is fixed on the sheet P.

When the image forming apparatus 400 is powered ON, parts of the image forming apparatus 400 are activated. At the same time, the fixing device 210 is started up, and power supply from the capacitor 216 to the heater 204 of the fixing device 210 is started to heat the fixing roller 201. Then, the power supply is controlled in accordance with the above-mentioned power supply operations. According to the image forming apparatus having the fixing device 210, since electric power stored in the capacitor device 216 is intensively used, the power supply from the external power source 215 to the heat generation part 206 can be suppressed at time of requiring a large amount of electric power, for example, at the start up time of the image forming apparatus 400. As a result, it is possible to efficiently use electric power supplied from the external power source 215 and reduce the maximum power consumed in the external power source 215.

It is noted that the fixing device 320 can be incorporated in the image forming apparatus 400 instead of the fixing device 210.

The present invention is not limited to the specifically disclosed embodiments, and variations and modifications may be made without departing from the scope of the present invention.

The present application is based on Japanese Patent Priority Applications No. 2003-087293 filed Mar. 27, 2003 and No. 093519 filed Mar. 31, 2003, the entire contents of which are hereby incorporated by reference.

What is claimed is:

1. A fixing device for fixing a toner on a sheet, comprising:

at least one electricity storage device;

a heat generation part generating heat by using electric power supplied from the at least one electricity storage device;

a fixing member heating the toner on the sheet to fix the toner on the sheet, said fixing member heated by the heat generation part; and a power control part configured to control the supply of electric power from at least one of an external power source and the at least one electricity storage device to the heat generation part;

wherein the power control part, when a temperature of the fixing member drops due to passage of one or more sheets, supplies electric power from not the external power source but from the at least one electricity storage device to the heat generation part.

2. The fixing device as claimed in claim 1, wherein the at least one electricity storage device comprises a capacitor.

3. The fixing device as claimed in claim 1, wherein the power control part comprises:

a selection part alternately selecting one of a first mode and a second mode, said first mode in which electric power is supplied from not the external power source but from the at least one electricity storage device to the heat generation part, said second mode in which electric power is supplied from not the at least one electricity storage device but from the external power source to the heat generation part.

4. An image forming apparatus, comprising:

the fixing device as claimed in claim 1, wherein the sheet on which a toner image is formed in accordance with an electrophotographic method is carried to the fixing device.

5. A fixing device for fixing a toner on a sheet, comprising:

at least one electricity storage device;

a heat generation part generating heat by using electric power supplied from the at least one electricity storage device;

a fixing member heating the toner on the sheet to fix the toner on the sheet, said fixing member heated by the heat generation part; and a power control part configured to control the supply of electric power from at least one of an external power source and the at least one electricity storage device to the heat generation part, the power control part including, a selection part alternately selecting one of a first mode and a second mode, said first mode in which electric power is supplied from not the external power source but from the at least one electricity storage device to the heat generation part, said second mode in which electric power is supplied from both of the at least one electricity storage device and the external power source to the heat generation part.

6. A fixing device for fixing a toner on a sheet, comprising:

a first heat generation part configured to generate heat using electric power supplied from an external power supply;

an electricity storage device;

a second heat generation part configured to generate heat using electric power supplied from the electricity storage device;

a fixing member configured to heat the toner to fix the toner on the sheet, said fixing member heated by at least one of the first and the second heat generation parts; and a power control part configured to control electric power supplied to at least one of the first and the second heat generation parts;

wherein the power control part is configured to supply electric power from the electricity storage device to the second heat generation part without supplying electric power from the external power supply to the first heat generation part.

7. The fixing device as claimed in claim 6, wherein the electricity storage device includes a capacitor.

8. The fixing device as claimed in claim 6, wherein the power control part is configured to supply electric power from the electricity storage device to the second heat generation part without supplying electric power from the external power supply to the first heat generation part at a start of electric power supply.

9. The fixing device as claimed in claim 6, wherein the power control part is configured to supply electric power from the electricity storage device to the second heat generation part without supplying electric power from the external power supply to the first heat generation part at a time of heating the unheated fixing member up to a toner fixable temperature.

10. The fixing device as claimed in claim 6, wherein the power control part is configured to supply electric power from the electricity storage device to the second heat generation part without supplying electric power from the external power supply to the first heat generation part when passage of one of more sheets through the fixing member leads to a decrease in temperature of the fixing member.

11. The fixing device as claimed in claim 6, wherein the power control part is configured to supply electric power from the external power supply to the first heat generation part without supplying electric power from the electricity storage device to the second heat generation part after a temperature of the fixing member reaches a toner fixable temperature.

12. The fixing device as claimed in claim 6, wherein the power control part includes a mode selection part configured to select a first mode or a second mode, the power control part being configured in the first mode to supply electric power from the electricity storage device to the second heat generation part without supplying electric power from the external power supply to the first heat generation part and in the second mode to supply electric power from the external power supply to the first heat generation part without supplying electric power from the electricity storage device to the second heat generation part.

13. The fixing device as claimed in claim 6, wherein the power control part includes a mode selection part configured to select a first mode or a second mode, the power control part is configured in the first mode to supply electric power from the electricity storage device to the second heat generation part without supplying electric power from the external power supply to the first heat generation part and in the second mode to supply electric power from the external power supply to the first heat generation part as well as from the electricity storage device to the second heat generation part.

14. The fixing device as claimed in claim 6, wherein the second heat generation part is connected to the electricity storage device and the external power supply to accept electric power from the electricity storage device and the external power supply.

15. An image forming apparatus comprising a fixing device for fixing a toner on a sheet, the fixing device including:

a first heat generation part configured to generate heat using electric power supplied from an external power supply;

an electricity storage device;

a second heat generation part configured to generate heat using electric power supplied from the electricity storage device;

a fixing member configured to heat the toner to fix the toner on the sheet, said fixing member heated by at least one of the first and second heat generation parts; and a power control part configured to control electric power supplied to at least one of the first and the second heat generation parts;

wherein the power control part is configured to supply electric power from the electricity storage device to the second heat generation part without supplying electric power from the external power supply to the first heat generation part.

* * * * *